US006213108B1

(12) United States Patent
Boyer et al.

(10) Patent No.: US 6,213,108 B1
(45) Date of Patent: Apr. 10, 2001

(54) SYSTEM AND METHOD FOR PROVIDING MULTICHARGE IGNITION

(75) Inventors: James Alva Boyer; Norman H. Bracken; Raymond O. Butler, Jr., all of Anderson, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/316,619

(22) Filed: May 21, 1999

(51) Int. Cl.[7] ..... F02P 15/10
(52) U.S. Cl. ..... 123/595; 123/606
(58) Field of Search ..... 123/595, 606, 123/625, 636, 637

(56) References Cited

U.S. PATENT DOCUMENTS 4,237,835 * 12/1980 Rabus et al. ..... 123/606
4,938,200 * 7/1990 Iwasaki ..... 123/606
5,462,036 10/1995 Kugler et al. ..... 123/609

* cited by examiner

*Primary Examiner*—Andrew M. Dolinar

(74) *Attorney, Agent, or Firm*—Margaret A. Debrewitsky

(57) ABSTRACT

A system and method of providing multicharge ignition are provided. The method and system preferably are adapted to trigger at least some of the multicharge events of the system and method in a current-dependent manner. Preferably, existing power train control units (PTCUs) can be used with the system and method, without the need for signals other than the timing signal (e.g., EST pulse) from the PTCU. The method comprises the steps of charging an inductive energy storage device by flowing electrical current through a primary side of the inductive energy storage device until a predetermined amount of energy is stored therein, discharging a portion of the predetermined amount of energy through a secondary side of the inductive energy storage device by opening a path of the electrical current through the primary side upon achieving the predetermined amount of energy in the inductive energy storage device, and repetitively closing and reopening the path to recharge and partially discharge, respectively, the inductive energy storage device, wherein reopening of the path is triggered based on the amount of energy stored in the inductive energy storage device. The multicharge ignition system comprises an inductive energy storage device and electronic ignition circuitry. The inductive energy storage device has primary and secondary sides inductively coupled to one another. The electronic ignition circuitry is connected to the primary side and is adapted to implement the aforementioned method.

47 Claims, 15 Drawing Sheets

SYSTEM AND METHOD FOR PROVIDING MULTICHARGE IGNITION

BACKGROUND OF THE INVENTION

The present invention relates to a system and method for providing multicharge ignition, and more specifically, to a method and system adapted to trigger at least some of the multicharge events of the system and method in a current-dependent manner and further adapted to terminate the sequence of recharging and partially discharging the inductive energy storage device of the ignition system based on a timing signal and without requiring other signals indicative of crank angle.

Generally, a repetitive spark distributorless ignition system stops ignition current before the complete discharge of magnetic energy in the ignition coil supplying the spark plug. During the stoppage, the ignition coil is recharged so an additional spark can be applied to the spark plug. The present invention relates to a system and method for igniting a combustible gaseous mixture, particularly a mixture of gasoline vapor and air in the combustion chamber of an internal combustion engine utilizing a spark plug.

Ignition of a fuel-air mixture in the combustion chamber of an internal combustion engine (ICE) is done by a spark plug in which a high-voltage spark, for example generated by discharge of a capacitor or coil, is caused to discharge across a firing or spark gap of the spark plug. The capacitor, or another energy storage device such as an ignition coil itself, is charged with energy and, at a predetermined time instant which may be controlled by a computer, the capacitor or other energy storage device discharges causing the spark to flash over at the spark gap. The spark gap ignites the combustible mixture within the combustion chamber of the ICE.

Timing of the spark in relation to the combustible charge, and the position of a piston in the ICE, usually taken with reference to the top dead-center (TDC) position of the piston, is important. The spark flash over usually is caused to occur at a predetermined time instant in advance of the TDC position of the piston so that the mixture will burn, and give off energy just at and after the piston has reached TDC position. To obtain maximum efficiency from the burning operation, it is important that the mixture should burn as rapidly as possible within the combustion chamber, and that a frontal zone of combustion, or flaming, of the combustible mixture propagates as rapidly as possible.

The electrical discharge which occurs at the spark gap of the spark plug under control of the associated ignition system is, unfortunately, not a clearly analyzable occurrence or event as, for example, an electrical square-wave pulse or the like which controls the discharge. Rudolf Maly of the Institut fur Physikalische Elektronik, Universitat Stuttgart, has suggested in numerous papers that as the spark forms, three phases can be distinguished, namely, (1) the breakdown phase, (2) the arcing phase, and (3) the glow phase.

The energy transferred in the various phases differs greatly. The formation of the respective phases depends to some extent on the geometry of the ignition electrodes, as well as on the associated circuitry connected thereto. If the ignition system provides a high-voltage pulse to the ignition electrodes, then, first, after the breakdown voltage has been exceeded, an electrically conductive plasma path will result. The currents which flow through the path between the electrodes may be very high. This occurs during phase (1), that is, the breakdown phase as the voltage falls from very high voltages (kilovolts) to voltages less than 10% of the peak.

The next phase is the arcing phase, the formation and course of which depends to some extent on the circuitry with which the spark plug is associated. The arcing phase causes current to flow in the previously generated plasma path. The voltage between the electrodes may be comparatively low or the current which flows at the beginning of the second, or arcing phase may be high. When the current during the arcing phase drops below a transition threshold, the arc will degenerate into a third, or glow phase which usually follows. The current during the third or glow phase continues to supply thermal energy to the media in the gap although much is lost to the electrodes during the relatively long period of time. During the glow phase, the voltage is above the value of the arcing phase voltage.

The spark plug is stressed differentially during the respective phases. In the breakdown phase, the heat loading on the spark plug is low. In the arcing phase, the heat loading is high, and heat which is applied to the ignition electrodes of the spark plug leads to the well known erosion and deterioration of the spark plug. Relatively little erosion takes place during the glow discharge because of the low current densities and currents (<100 ma) that can be sustained.

The loading conditions applied to an Otto-type ICE result in different conditions of combustible mixtures in the combustion chamber. Upon full load operation, the mixture is rich and the degree of fill of the combustion chamber is high. Igniting such a mixture does not pose any significant problems. An accelerated transfer of energy is not even necessarily desired. If the ICE, however, operates at low loading, or under idling condition or, even under engine braking conditions, the temperature within the combustion chamber drops rapidly and the pressure also drops. The mixture is lean, and the degree of fill of the combustion chamber of the ICE is low. Non-homogenates of the mixture occur, and consequently, ignition of the already lean, and possibly non-homogenous and insufficiently filled, mixture may cause difficulties.

Ignition systems are known which provide a succession of spark breakdowns in order to ensure ignition of the combustible mixture in an ICE. For example, it is known to sense the composition of the combustible fuel-air mixture, and to control the number of spark flash-overs, or breakdowns at the sparking electrodes of the spark plug as a function of the ratio of fuel to air in the combustible fuel-air mixture.

U.S. Pat. No. 4,653,459 to Herden teaches engine control using the relationship of the number of spark breakdowns to the fuel-air mixture composition being supplied of the engine. However, specially constructed spark plugs are required to enhance the breakdown phase. Furthermore, the higher energy impulses of these breakdown sparks may lead to undesirable RFI (radio frequency interference) emissions.

To avoid having to reconfigure the ignition components, U.S. Pat. No. 5,014,676 to Boyer suggests the desirability of using conventional inductive discharge hardware, preferably in a distributorless configuration, with repetitive firing, and further suggests communicating the ON/OFF control for this mode from a main engine control computer. According to the '676 patent, by truncating the length of each glow discharge to recover energy which otherwise would be lost to the spark plug electrodes and providing a number of fresh ignition sources in a turbulent mixture by repetitively firing the same spark plug gap, there exists a higher probability of igniting a lean mixture.

While the arrangement disclosed in the '676 patent is acceptable in many situations, it does not adequately compensate for actual variations in the conditions within the combustion chamber after the first spark. Once the '676 arrangement determines, based on the operating conditions of the engine, that sparking will be provided repetitively, the events that trigger each application of energy which is intended to generate one of the sparks are primarily time-based events. That is, each attempt to generate a spark in the repetitive sequence is triggered and terminated at specified times.

While the specified times are different from one attempt to the next, they are pre-set and do not change to compensate for actual variations in the amount of energy required to recharge the energy storage device (e.g., the ignition coil) for the next application of a spark. Nor do the pre-set time values change to compensate for actual variations in the amount of energy dissipated by each spark subsequent to the first. When these actual variations are significant, which is not uncommon due to variations in the conditions within the combustion chamber, the arrangement disclosed in the '676 patent provides less than ideal firing characteristics.

The variations in conditions within the combustion chamber (e.g., whether there is a high-flow condition or a low-flow condition in the combustion chamber) can cause the amount of energy dissipated by a sparking event subsequent to the initial spark to vary by as much as one order of magnitude. In low flow conditions, for example, it may take as little as 200–300 volts to sustain a spark after the initial spark. In particular, the medium between the electrodes of the spark plug remains ionized and therefore facilitates restriking of the spark plug. Under high flow conditions, by contrast, it may take 2,000 volts to sustain the same spark in the sequence because of the lack of ionization between the electrodes of the spark plug. There consequently can be a 10:1 variation in the amount of energy dissipated and thus in the amount of energy required by the coil to ensure that a spark is sustained. Such large variations mean that if the discharge trigger time is pre-set based on the erroneous assumption that the combustion chamber conditions will require only a small amount of energy to ignite the spark, the amount of time allocated for recharging may be too short to sustain the desired spark (e.g., in high flow conditions). Conversely, if the discharge trigger time is pre-set based on the opposite erroneous assumption, namely, that the combustion chamber conditions will require a large amount of energy to ignite the spark, then the time allocated to recharging may be longer than is necessary, thereby unduly lengthening the time between successive sparks and/or overcharging the coil. In either case, the ignition system would provide less than ideal performance.

Even if the pre-set times are determined based on the assumption that the conditions within the combustion chamber will remain substantially mid-range between those requiring a large amount of energy and those requiring little energy, the magnitude of possible variations in energy requirements (i.e., the aforementioned 10:1 ratio) prevents that approach from completely eliminating the potential for inadequate performance.

There is consequently a need in the art for a multicharge ignition system capable of providing the advantages associated with repetitive spark generation, while adequately compensating for variations in dissipation and recharge energy from one spark event to the next in each repetitive spark generation sequence. In this regard, there is a need in the art for a multicharge ignition system in which the discharge events are triggered based on the amount of energy stored in the coil of the ignition system.

While U.S. Pat. No. 5,462,036 to Kugler et al. does provide discharge events that are triggered based on the amount of current in a primary winding, the device disclosed by Kugler et al. requires more than one input signal (e.g., speed of rotation n, pressure p, supply voltage Up, temperature T, and the like). These signals are used by the Kugler et al. device to determine, among other things, the ignition time ZZP. Since the Kugler et al. device is not responsive to a single timing signal (e.g., an EST signal) from a PTCU, but rather a plurality of input signals, it generally is employed as a replacement for existing PTCUs.

Replacement or modification of existing PTCUs, however, is not necessarily desirable or practical. Manufacturing of existing PTCU's has been substantially refined over the many manufacturing runs of the PTCUs. The use of existing PTCU's also tends to minimize tool-up time and production costs. In addition, since existing PTCUs have been used and tested in actual vehicles and have been refined based on the results of such use over significant periods of time, it is generally desirable to take advantage of their proven reliability by providing an ignition system that uses existing PTCUs and adds little, if anything, more than what is necessary to enable existing PTCU's to provide multicharge ignition. In this regard, there is generally a need for a multicharge ignition system and method adapted to terminate the sequence of recharging and partially discharging the inductive energy storage device based on the timing signal (e.g., the EST signal) from an existing PTCU. Since manufacturing expedients are achieved by minimizing the inputs to any additional multicharge circuitry, a need exists for multicharge ignition systems and methods that are capable of implementation without requiring input signals other than the timing signal (e.g., without requiring signals indicative of crank angle, for example).

SUMMARY OF THE INVENTION

It is a primary object of the present invention to overcome the foregoing problems and to satisfy at least one of the aforementioned needs by providing a multicharge ignition system and method adapted to provide repetitive sparks, using inductive discharge, without the need for special spark plug configurations or capacitive discharge energy storage and in a manner which compensates for variations in dissipation and recharge energy from one spark event to the next in each repetitive spark generation sequence.

Another object of the present invention is to provide a multicharge ignition system in which at least some of the discharge events are triggered based on the amount of energy stored in the inductive storage component of the ignition system.

Still another object of the present invention is to provide the multicharging ignition system in which at least some of the discharge events are triggered based on the current flowing through the primary winding of the inductive storage component of the ignition system.

Yet another object of the present invention is to provide a multicharge ignition system and method adapted to terminate the sequence of recharging and partially discharging the inductive energy storage device based on a timing signal (e.g., from an existing PTCU, such as an EST signal) and without requiring other signals indicative of crank angle.

To achieve these and other objects, the present invention provides a multicharge ignition system for connection to a spark plug of an internal combustion engine. The multicharge ignition system comprises an inductive energy storage device and electronic ignition circuitry. The inductive energy storage device has primary and secondary sides inductively coupled to one another. The electronic ignition circuitry is connected to the primary side and is adapted to receive a timing signal indicative of when firing of the spark plug is to commence. The electronic ignition circuitry is responsive to the timing signal by charging the inductive energy storage device by flowing electrical current through the primary side until a predetermined amount of energy is stored in the inductive energy storage device. The electronic ignition circuitry is further adapted to discharge a portion of the predetermined amount of energy through the secondary side by opening a path of the electrical current through the primary side upon achieving the predetermined amount of energy in the inductive energy storage device. The electronic ignition circuitry is further adapted to close this path and reopen this path repetitively to recharge and partially discharge, respectively, the inductive energy storage device. The electronic ignition circuitry is arranged so that reopening of the path is triggered based on the amount of energy stored in the inductive energy storage device.

Preferably, the electronic ignition circuitry further includes a switch connected to the aforementioned current path and adapted to selectively open the path when the current flowing through the path rises to a predetermined threshold at which the inductive energy stored in the inductive energy storage device corresponds to the predetermined amount of energy.

The electronic ignition circuitry further can include timing circuitry adapted to provide a time-out signal when a predetermined period of time has elapsed after opening of the switch. This switch, in this regard, can be further responsive to the time-out signal and can be adapted to close the path upon receiving the time-out signal to effect recharging of the inductive energy storage device.

The present invention also provides a multicharge ignition system in an internal combustion engine. The engine has a timing control unit, a plurality of combustion chambers, and at least one spark plug in each combustion chamber. The multicharge ignition system is connected to each spark plug and is also connected to the timing control unit. The multicharge ignition system comprises an inductive energy storage device for each combustion chamber, and electronic ignition circuitry. Each inductive energy storage device has primary and secondary sides inductively coupled to one another. The electronic ignition circuitry is connected to the primary side of each inductive energy storage device and is adapted to receive, from the timing control unit, a timing signal indicative of when firing of each spark plug is to commence. The electronic ignition circuitry is further responsive to the timing signal by charging a respective one of the inductive energy storage devices by flowing electrical current through the primary side thereof until a predetermined amount of energy is stored therein. The electronic ignition circuitry is further adapted to discharge a portion of the predetermined amount of energy through the secondary side of the respective one of the inductive energy storage devices by opening a path of the electrical current through the primary side upon achieving the predetermined amount of energy in the respective one of the inductive energy storage devices. The electronic ignition circuitry is further adapted to close the path and reopen the path repetitively to recharge and partially discharge, respectively, the respective one of the inductive energy storage devices. The electronic ignition circuitry is adapted to sequentially designate, in a predetermined firing order, which of the inductive energy storage devices constitutes the respective one. The electronic ignition circuitry also is arranged so that reopening of the path is triggered based on the amount of energy stored in inductive energy storage device.

Also provided by the present invention is a method of providing multicharge ignition for an internal combustion engine. The method comprises the steps of charging an inductive energy storage device by flowing electrical current through a primary side of the inductive energy storage device until a predetermined amount of energy is stored therein, discharging a portion of the predetermined amount of energy through a secondary side of the inductive energy storage device by opening a path of the electrical current through the primary side upon achieving the predetermined amount of energy in the inductive energy storage device, and repetitively closing and reopening the path to recharge and partially discharge, respectively, the inductive energy storage device, wherein reopening of the path is triggered based on the amount of energy stored in the inductive energy storage device.

Preferably, the step of repetitively closing and reopening the path includes the step of determining, prior to each repetition of closing and reopening, whether a next repetition, if executed so that the reopening is long enough to discharge the predetermined amount of energy substantially completely through the secondary side, would require the next repetition to extend beyond a predetermined desired sparking duration during which it is desirable to have a spark present at the spark plug. In addition, the method preferably further includes the step of opening the path for a period of time long enough for the predetermined amount of energy to be discharged substantially completely through the secondary side when it is determined that the next repetition would extend beyond the predetermined desired sparking duration.

Also provided by the present invention, in an internal combustion engine having a timing control unit, a plurality of combustion chambers, and at least one spark plug in each combustion chamber, is a multicharge ignition system connected to each spark plug and also connected to the timing control unit. The multicharge ignition system comprises an inductive engery storage device for each combustion chamber and electronic ignition circuitry for each combustion chamber. Each inductive energy storage device has primary and secondary sides inductively coupled to one another. Each electronic ignition circuitry is connected to a respective primary side of a respective inductive energy storage device and is adapted to receive, from the timing control unit, a respective timing signal indicative of when firing of a respective spark plug is to commence. Each electronic ignition circuitry is responsive to its respective timing signal by charging its respective inductive energy storage device by flowing electrical current through the primary side thereof until a predetermined amount of energy is stored therein. Each electronic ignition circuitry is further adapted to discharge a portion of the predetermined amount of energy through the secondary side of its respective inductive energy storage device by opening a path of the electrical current through the primary side upon achieving the predetermined amount of energy in the respective inductive energy storage device. Each electronic ignition circuitry is further adapted to close the path and reopen the path repetitively to recharge and partially discharge, respectively, its respective inductive energy storage device. Each electronic ignition circuitry is further arranged so that reopening of the path is triggered based on the amount of energy stored in the inductive energy storage device. The ignition circuitry is further adapted to terminate the sequence of recharging and partially discharging the inductive energy storage device based on the respective timing signal and without requiring other signals indicative of crank angle.

Still other objects, advantages, and features of the present invention will become more readily apparent when reference is made to the accompanying drawings and the associated description contained herein.

DESCRIPTION OF PREFERRED EMBODIMENTS

The preferred embodiments of the present invention will be described in the context of an internal combustion engine having a certain number of cylinders. It is understood, however, that the invention can be applied to engines having any number of cylinders, as well as engines having non-cylindrical combustion chambers (e.g., rotary engines).

Figure 1:
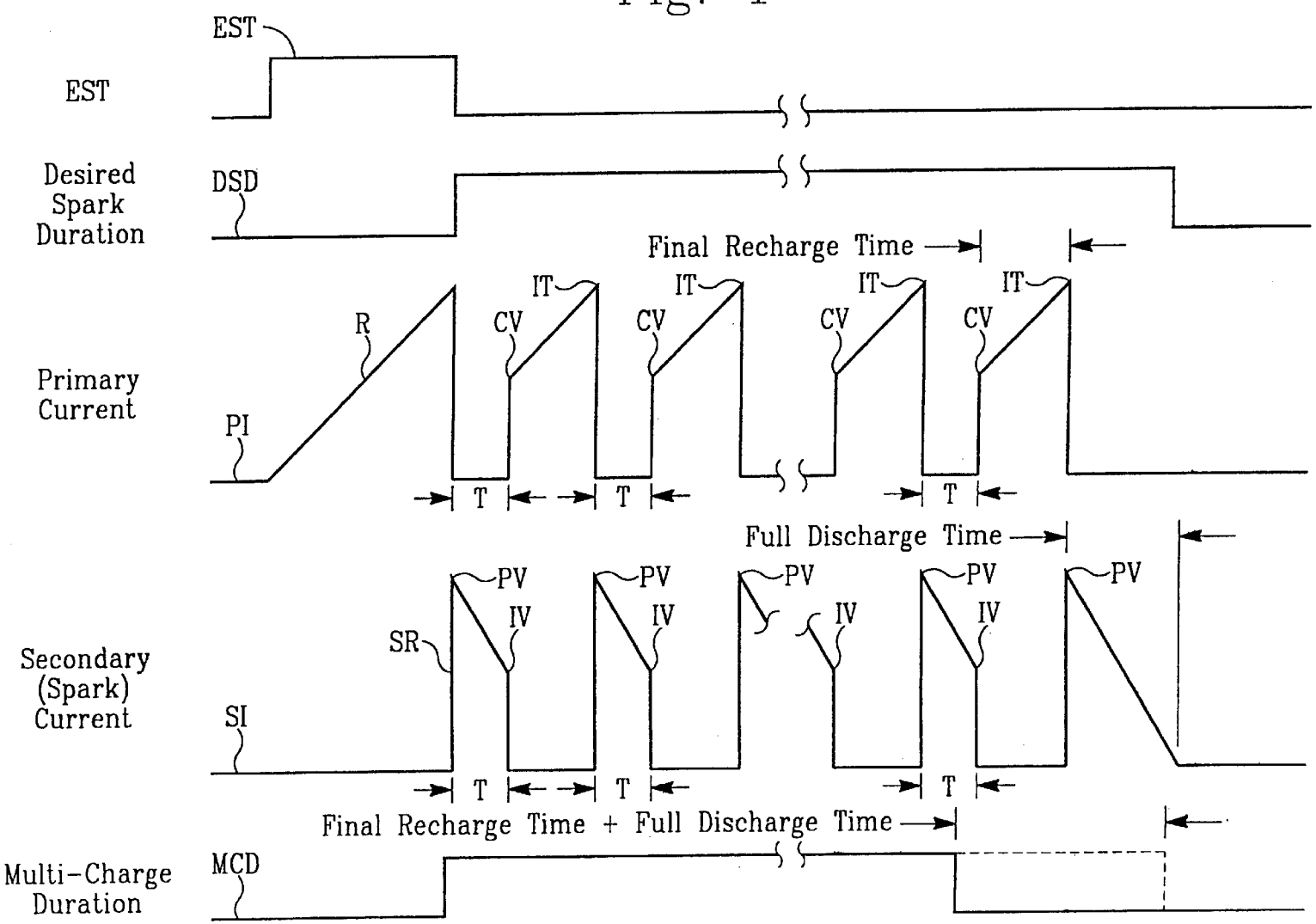
FIG. 1 is a timing diagram of a multicharging method according to a preferred implementation of the present invention.

FIG. 1 is a timing diagram of a multicharge method according to a preferred implementation of the present invention. EST in FIG. 1 denotes a timing signal which is generated by the power train control unit (PTCU) of many production vehicles. The EST signal indicates when the next firing of a spark plug is to commence. Typically, one EST pulse is delivered for each firing. Thus, in an eight-cylinder, four-stroke engine, for example, each pair of revolutions of the engine will result in eight EST pulses of the type illustrated in FIG. 1. The EST pulses are temporally separated and used to trigger a sparking event in one or more of the combustion chambers according to a predetermined firing order.

Typically, the PTCU is programmed to deliver each EST pulse with a predetermined pulse width (or duration) that is intended to control the charging time of an ignition coil or other ignition energy storage device. The EST pulse rises (or otherwise exhibits a first transition) when the PTCU determines that charging of the coil should begin and falls (or otherwise exhibits a second transition) when the PTCU determines that ignition of the fuel/air mixture in the respective combustion chamber should begin. The typical PTCU therefore triggers each spark using the trailing edge (or transition) of the EST pulse.

Rather than modify conventional PTCUs, a preferred implementation of the present invention using the same EST pulses, but provides multicharging and multiple sparks in response thereto.

The multiple sparks are generated over a period of time during which it is desirable to have a spark present in the respective combustion chamber. Empirically, it has been determined that for most internal combustion engines, this period of time corresponds to the time it takes for the engine to rotate about 10 to 30 degrees, and more desirably, about 20 degrees of engine rotation. This period of time varies as a function of engine speed. At higher engine speeds, the desired spark duration is shorter because it takes less time for the engine to rotate the desired number of degrees (e.g., about 20 degrees).

The DSD timing pattern in FIG. 1 denotes the desired spark duration. Notably, the DSD timing pattern begins when the EST pulse drops. The desired spark duration DSD ends after the engine has rotated the desired number of degrees. FIG. 1 also shows the approximate primary and secondary electrical currents PI and SI in the primary and secondary sides (e.g., windings) of an inductive energy storage device (e.g., an ignition coil) according to the preferred implementation of the present invention.

Notably, the initial rise R in primary current PI is triggered by the rise in the EST pulse. The rate at which the primary current PI rises is a function of the voltage applied across the primary side, as well as the inductance of the ignition coil. This rate is fairly predictable. Thus, an ignition coil can be provided with characteristics that enable it to inductively store a predetermined amount of energy in response to application of a predetermined voltage for a predetermined period of time across its primary side. The energy is stored in the form of a progressively rising magnetic field generated by the progressively rising primary current PI. By designing the coil so that the predetermined period of time coincides with the pulse width of the EST pulse, it is possible to have the coil reliably provide a desired high voltage (e.g., 35,000 volts) across the secondary side (i.e., the spark plug side of the coil) in response to abrupt termination (triggered by the falling EST pulse) of a much smaller voltage, after that much smaller voltage has been applied across the primary side for the duration of the EST pulse. The desired high voltage is enough to overcome the resistance across the spark plug gap, and therefore provides a spark across the gap. The spark is reflected in FIG. 1 by the first sudden rise SR in secondary current SI. Thus, an initial time-based application and abrupt termination of energy across the primary side can reliably provide a desired initial current flow through the secondary side of the coil and through the spark plug gap.

In the multicharge environment of the preferred implementation, however, the inductively stored energy is not allowed to discharge completely before the next application of energy to the primary side. Instead, the discharge of energy through the secondary side (the secondary current flow SI through the spark plug) is terminated by reapplying primary current PI, preferably within about half the time it would have taken for a complete discharge of the ignition coil (i.e., for a complete collapse of the magnetic field in the coil). This advantageously charges the ignition coil and discharges energy from the ignition coil through the spark plug gap using the most efficient part of the charging and discharging cycle.

Conditions within the combustion chamber can vary significantly, as indicated above. Such variations have a significant impact on the amount of energy dissipated by the spark. It therefore is difficult to reliably predict how long the next application of energy to the primary side should last for it to result in storage of the predetermined amount of energy. As indicated above, there can be a 10:1 variation in the amount of energy dissipated by the spark. A reapplication of energy to the primary side that is strictly time-based therefore could result in an insufficient recharge cycle, overcharging, or undue delay in delivery of the next spark.

The preferred implementation of the present invention therefore triggers the reopenings of the current path through the primary side in a current-based manner. As shown in FIG. 1, after having been open for a predetermined period of time T, the path through the primary side is closed. This causes the primary current PI to rise gradually from a starting current value CV. Notably, predetermined period of time T is not long enough to provide anywhere near a complete discharge of the coil, and consequently, the starting current value CV is significantly higher than zero. Preferably, the predetermined period of time T is selected to be no more than half of the time required to achieve a substantially complete discharge. Preferably, the coil design and related variables are selected so that the predetermined period of time is about 0.15 to 0.25 milliseconds, and more desirably, between about 0.15 and 0.2 milliseconds.

The terms "closing" and "opening" when used with reference to the path for electrical current are intended to be consistent with the use of such terms in the electrical arts. Thus, a "closed" path allows current to flow, whereas an "open" path prevents the flow of current through the open part of the path.

When the primary current PI reaches a predetermined threshold IT, the path through the primary side is reopened. Desirably, the predetermined threshold IT is set between about 5–17 amperes, and more desirably between about 7 and 15 amperes. The particular ampere value is selected so that the collapsing magnetic field around the primary side inductively generates the desired high voltage across the secondary side. This high voltage (e.g., 35,000 volts) is enough to reliably overcome the resistance across the spark plug gap regardless of the conditions within the combustion chamber. As this is repeated, multiple sparks are reliably generated across the spark plug gap. This is evidenced by the repetitive rises in secondary current PI to peak value PV, followed by drops to intermediate value IV over the predetermined period of time T. Since the lack of total discharge increases the efficiency of the charging and discharging cycle, the cumulative time during which a spark is present can be optimized. This, in turn, makes the combustion process within the combustion chamber more reliable.

While it is possible to terminate the repetitions of closing and reopening the current path through the primary side by permitting the coil to completely discharge when it is determined that the engine has rotated the predetermined number of degrees (e.g., 20 degrees), such an arrangement could result in sparking after the desired spark duration DSD. For example, if the path through the primary side is closed immediately prior to the end of the desired spark duration (DSD), charging of the coil would not end until the predetermined current threshold IT is reached some time thereafter. The complete discharge of the coil therefore would occur significantly later than the end of the desired spark duration (DSP).

A preferred implementation of the present invention therefore includes the step of determining, prior to each repetition of closing and reopening the current path through the primary side, whether a next repetition, if executed so that the energy in the coil discharges completely through the secondary side, would require the next repetition to extend beyond the desired sparking duration DSD. If that determination yields an affirmative result, the present reopening of the current path through the primary side is performed for a period of time long enough for the predetermined amount of energy to be discharged completely through the secondary side. The final discharge of the coil therefore occurs more contemporaneously with the end of the desired spark duration (DSD).

Since the desired spark duration (DSD) in units of time (as opposed to in units of degrees of engine rotation) varies as a function of engine speed, the foregoing determination regarding the duration of the last recharge and discharge cycle should not be based solely on a constant "preset" spark duration time. It also should not be based solely on a constant "preset" multicharge duration time (i.e., a never-changing duration of the aforementioned repetitions other than the repetition that results in complete discharging of the coil). Instead, the multicharge duration, which is denoted as MCD in FIG. 1, and the desired spark duration DSD should be adjusted as the engine speed varies.

According to the preferred implementation, therefore, information regarding the time separating the last two EST pulses is scaled down by a factor corresponding to the desired number of degrees of engine rotation over which the presence of the spark is desirable, and this scaled down time is used to predict the present multicharge duration MCD. This aspect of the preferred implementation takes advantage of the fact that the engine speed will not vary significantly from the firing of one cylinder to the next. The previous time between EST pulses therefore is a good indication of the time it takes for the engine to rotate the predetermined number of degrees (e.g., about 20 degrees).

The scaling value itself depends on the predetermined number of degrees of engine rotation. If each combustion chamber (or cylinder) receives its own EST pulse only and the time between such individualized EST pulses is used, then the scaling value is simply the predetermined number of degrees divided by 720 (the number of degrees of engine rotation between successive EST pulses for one cylinder). The scaling factor for twenty degrees of engine rotation therefore is 1/36.

If, by contrast, the time between successive EST pulses is measured between the EST pulses that control firing of not only the same but different combustion chambers, then the scaling value will depend also on the number of combustion chambers (or cylinders). In particular, the scaling value will be the number of degrees times the number of cylinders, divided by 720. Thus, for an eight-cylinder engine, for example, the scaling factor will be 20 times 8 divided by 720 (or 2/9).

Since some PTCUs sequentially apply the EST pulses for all of the combustion chambers (or cylinders) on the same EST line, the following chart shows the number of degrees of engine rotation associated with the indicated scaling factors for conventional 4-cylinder, 6-cylinder, and 8-cylinder engines:

| Scaling Value | Degrees for 4-Cylinders | Degrees for 6-Cylinders | Degrees for 8-Cylinders |
|---|---|---|---|
| 0.01 | 1.8 | 1.2 | 0.9 |
| 0.02 | 3.6 | 2.4 | 1.8 |
| 0.03 | 5.4 | 3.6 | 2.7 |
| 0.04 | 7.2 | 4.8 | 3.6 |
| 0.05 | 9 | 6 | 4.5 |
| 0.06 | 10.8 | 7.2 | 5.4 |
| 0.07 | 12.6 | 8.4 | 6.3 |
| 0.08 | 14.4 | 9.6 | 7.2 |
| 0.09 | 16.2 | 10.8 | 8.1 |
| 0.10 | 18 | 12 | 9 |
| 0.11 | 19.8 | 13.2 | 9.9 |
| 0.12 | 21.6 | 14.4 | 10.8 |
| 0.13 | 23.4 | 15.6 | 11.7 |
| 0.14 | 25.2 | 16.8 | 12.6 |
| 0.15 | 27 | 18 | 13.5 |
| 0.16 | 28.8 | 19.2 | 14.4 |
| 0.17 | 30.6 | 20.4 | 15.3 |
| 0.18 | 32.4 | 21.6 | 16.2 |
| 0.19 | 34.2 | 22.8 | 17.1 |
| 0.20 | 36 | 24 | 18 |
| 0.21 | 37.8 | 25.2 | 18.9 |
| 0.22 | 39.6 | 26.4 | 19.8 |
| 0.23 | 41.4 | 27.6 | 20.7 |
| 0.24 | 43.2 | 28.8 | 21.6 |
| 0.25 | 45 | 30 | 22.5 |
| 0.26 | 46.8 | 31.2 | 23.4 |
| 0.27 | 48.6 | 32.4 | 24.3 |
| 0.28 | 50.4 | 33.6 | 25.2 |
| 0.29 | 52.2 | 34.8 | 26.1 |
| 0.30 | 54 | 36 | 27 |

Scaling of the time between EST pulses thereby provides a reliable prediction of the actual sparking duration, in units of time, required to provide sparking during the predetermined number of degrees of engine rotation (e.g., about 20 degrees). This prediction of the actual sparking time then can be used to determine the end of the multicharge duration MCD. In particular, this determination can be made using information regarding how long the final "recharge and complete discharge" cycle lasted in an immediately preceding firing cycle. That information provides a reliable prediction of how long the upcoming final "recharge and complete discharge" cycle will last. Thus, the duration of the preceding final recharge and complete discharge cycle is subtracted (or made negative and added) to the predicted duration of the spark, in units of time, which was determined by scaling the time between EST pulses.

At the end of the predicted multicharge duration MCD, the current path through the primary side of the ignition coil is kept from performing partial discharges. In particular, once the predetermined current threshold IT is reached, the path through the primary side is opened but does not reclose within the time period T. The final recharging and discharging cycle therefore results in a complete discharge of the energy in the coil. Notably, this final recharge and discharge sequence terminates very close to the end of the desired spark duration DSD and thus very close to the end of the desired amount of engine rotation. The coil design and related variables preferably are selected so that a complete discharge of the coil takes about 0.5 milliseconds.

While FIG. 1 shows a single firing sequence which occurs during one power stroke in one combustion chamber, it will be appreciated that the illustrated firing sequence can be repeated for each power stroke of the same combustion chamber, as well as the power strokes of any other combustion chambers. The EST pulses which trigger the various firing sequences can be provided in parallel to each individual combustion chamber, or alternatively, can be provided sequentially on the same EST line. The sequential configuration can be implemented, for example, by providing suitable distribution means capable of distributing each EST pulse or the energy triggered thereby to the appropriate combustion chamber(s) associated with that particular EST pulse.

Figure 2:
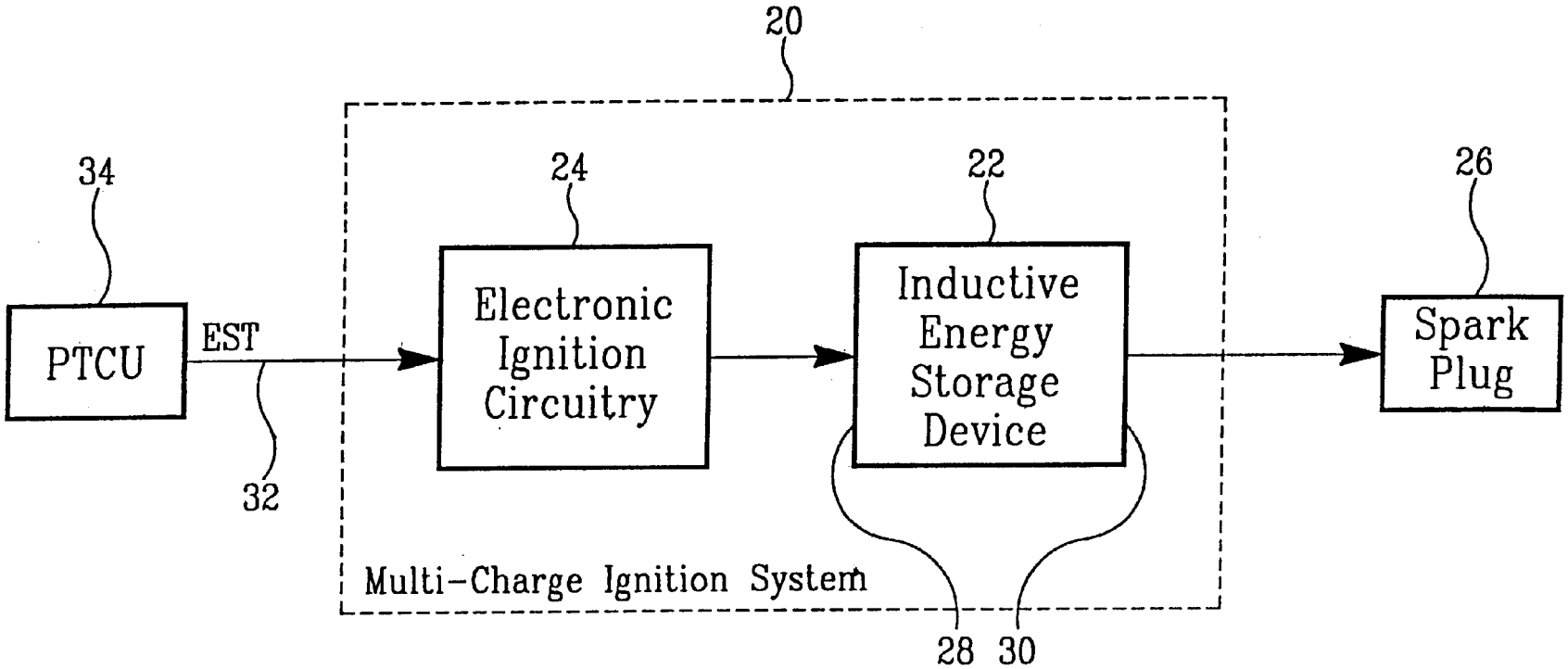
FIG. 2 is a block diagram of a multicharge ignition system according to a preferred embodiment of the present invention.

FIG. 2 illustrates an exemplary multicharge ignition system 20 capable of performing the aforementioned preferred implementation of the present invention. System 20 includes an inductive energy storage device 22 and electronic ignition circuitry 24. The multicharge ignition system 20 can be connected to a spark plug 26 of an internal combustion engine. The inductive energy storage device 22 of the system 20 has primary and secondary sides 28,30 inductively coupled to one another. Since the inductive energy storage device 22 typically will comprise an ignition coil, the primary and secondary sides typically will be defined by the windings of the ignition coil.

The electronic ignition circuitry 24 is connected to the primary side 28. It is adapted to receive a timing signal 32 (e.g., EST pulses from the PTCU 34) indicative of when firing of the spark plug 26 is to commence and is responsive to that timing signal by charging the inductive energy storage device 22. In the case of an ignition coil, the charging is achieved by flowing electrical current through the primary winding until a predetermined amount of energy is stored in the ignition coil (e.g., until a predetermined amount of current flow is established through the primary winding).

The electronic ignition circuitry 24 is further adapted to discharge a portion of the predetermined amount of energy through the secondary side 30 by opening the path of the electrical current through the primary side 28. In particular, the current path through the primary side 28 is opened upon achieving the predetermined amount of energy in the inductive energy storage device 22. This can be determined by the electronic ignition circuitry 24 based on the timing signal 32. The timing signal 32 (e.g., the EST pulse), as indicated above, typically will exhibit two transitions for each power stroke. The first transition signifies when charging of the inductive energy storage device 22 is to commence, whereas the second transition is temporally spaced from the first transition so that, if charging of the inductive energy storage device 22 begins in response to the first transition, the second transition will occur at the instant when the predetermined amount of energy has been accumulated in the inductive energy storage device 22. The path through the primary side 28 therefore is initially opened by the electronic ignition circuitry 24 in response to the second transition.

The ability to provide a timing signal which reliably corresponds to this charging time is facilitated by the predictability of the charging time during the initial charging process. Notably, the initial charging process starts from a zero energy state (i.e., zero current flow) in the coil. There is consequently little, if any, uncertainty regarding how long it will take to accumulate the predetermined amount of energy in the inductive energy storage device 22.

The electronic ignition circuitry 24 therefore is adapted to respond to the second transition in the timing signal 32 (e.g., the trailing edge of the EST pulse) by opening the current path through the primary side 28 and allowing the energy to be partially discharged through the secondary side 30. In providing this partial discharge, the electronic ignition circuitry 24 preferably keeps the path open for no more than half the time required for the magnetic field in the ignition coil to completely collapse. As indicated above, this ensures that the initial partial discharge is performed using only the most efficient part of the complete discharge process.

The electronic ignition circuitry 24 also is adapted to repetitively close and reopen that path to recharge and partially discharge, respectively, the inductive energy storage device 22. Each reopening of the path of the electric current through the primary side 28 by the electronic ignition circuitry 24 preferably is triggered based on the amount of energy stored in the inductive energy storage device 22. Since this amount of energy is proportional to the amount of current flowing through the primary side 28, the electronic ignition circuitry 24 can achieve the energy-based triggering by reopening the path in response to detecting a predetermined amount of current flowing through the primary side 28. The predetermined amount of current preferably is a value of current between 5 and 17 amperes, more desirably between 5 and 15 amperes, and most desirably, between 5 and 10 amperes.

While current detection is described, it is understood that voltage detection can also be used to the extent that the voltage being detected is indicative of current. The voltage across a resistor through which the current flows, for example, is indicative of the value of current flowing through the resistor. This relationship, commonly referred to as Ohm's law, is V=IR (where V is the voltage, I is the current, and R is the resistance).

During each iteration of the repetitive closing and reopening cycle, the path is opened by the electronic ignition circuitry 24 for a predetermined period of time, preferably between about 0.15 and 0.2 millisecond. This period of time T represents the time during which the inductive energy storage device 22 partially discharges enough energy through its secondary side 30 to generate a spark at the spark plug 26. Preferably, the predetermined period of time also is selected so that the path is open for no more than half the time it would take for all of the predetermined amount of energy to be completely discharged through the secondary side 30. This holds true for all repetitions except for the final one in the multicharge sequence.

When the path is opened for the final repetition in a desired sparking duration, the electronic ignition circuitry 24 keeps the path open long enough for all of the energy in the inductive energy storage device 22 to discharge through the secondary side 30. The final repetition therefore completely discharges the energy storage device 22.

In particular, the electronic ignition circuitry 24 can be adapted to determine, prior to each repetition of a closing and reopening cycle, whether a next repetition, if executed so that the reopening is long enough to discharge the predetermined amount of energy substantially completely through the secondary side 30, would require the next repetition to extend beyond the predetermined desired sparking duration DSD. Based upon the result of this determination, the electronic ignition circuitry 24 controls how long the path will remain open. More specifically, the electronic ignition circuitry 24 is adapted to open the path for a period of time long enough for the predetermined amount of energy to be discharged substantially completely through the secondary side 30 whenever it is determined that the next repetition would extend beyond the predetermined desired sparking duration DSD.

Preferably, the electronic ignition circuitry 24 is adapted to make this determination regarding the next repetition based on how long it took to complete a previous cycle of closing the path, opening the path, and keeping the path open long enough for the predetermined amount of energy to be discharged substantially completely through the secondary side 30. The previous cycle upon which this determination is based can be associated with the same or a different combustion chamber.

The electronic ignition circuitry 24 itself can be implemented using many combinations of analog circuitry, hardware, firmware, and/or software. Such combinations can be programmed or otherwise configured to perform the aforementioned functions.

An exemplary arrangement for an engine having multiple combustion chambers includes an ignition coil for each combustion chamber and a single electronic ignition circuit capable of providing the -functions described above in connection with the electronic ignition circuitry 24.

Figure 3:
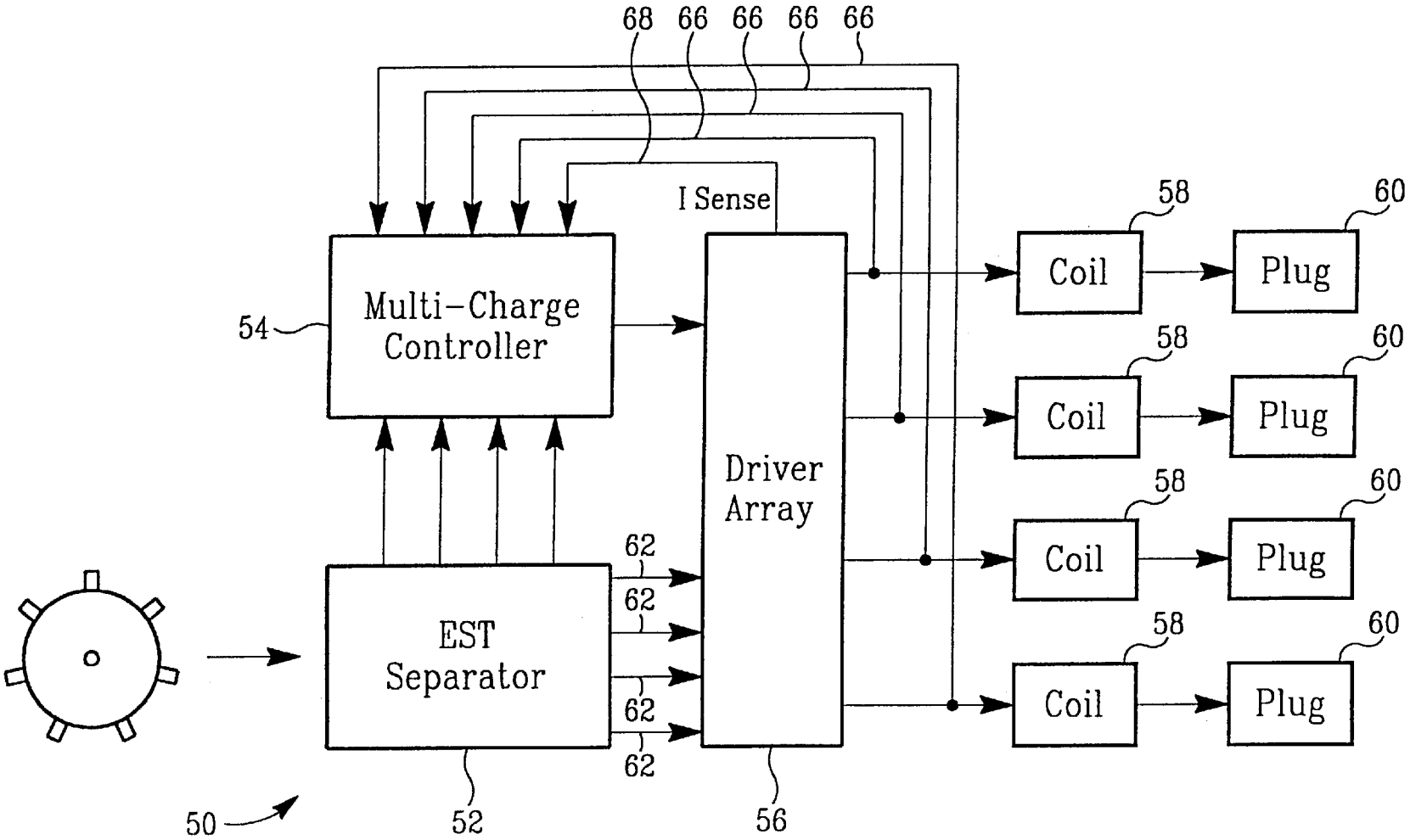
FIG. 3 is a block diagram of a preferred implementation of the embodiment shown in FIG. 2.

FIG. 3 illustrates an exemplary implementation of such an arrangement. The exemplary implementation is for a four-cylinder engine. One having ordinary skill in the art, however, would have no difficulty extending the teachings in the following description of the exemplary implementation to engines having a different number of cylinders or combustion chambers.

The exemplary multicharge ignition system 50 in FIG. 3 includes an EST separator 52, a multicharge controller 54 adapted to perform the functions described above in connection with the electronic ignition circuitry 24, and a driver array 56. The EST separator 52 is included in FIG. 3 because it is assumed that the PTCU provides all of the EST pulses sequentially on the same EST line. If, instead, the EST pulses are provided in parallel or otherwise are already separated for each combustion chamber or group thereof, the EST separator 52 can be eliminated.

In the exemplary embodiment, each combustion chamber is provided with its own coil 58 and its own spark plug 60. Preferably, each coil 58 is an ion sense coil. The driver array 56 is connected to the coils 58 and controls the application of current through the primary windings thereof. In particular, the driver array 56 provides this control in response to signals from the EST separator 52 and the multicharge controller 54. The signals from the EST separator 52 determine which of the coils 58 is active, and the signals from the multicharge controller 54 control how each coil 58 is activated.

The EST separator 52 provides four output lines 62 to the driver array 56. Each output line 62 carries the EST pulse for one of the combustion chambers. The EST separator 52 therefore takes the first EST pulse from the PTCU and sends it down the first output line 62, it takes the second EST pulse from the PTCU and transmits it down the second output line 62, and so forth. The separated EST pulses also are applied to the multicharge controller 54, where they are ORed together. Alternatively, the EST pulses from the PTCU can be applied directly to the multicharge controller 54.

The multicharge controller 54 preferably receives feedback signals 66 from the primary sides of the coils 58 indicating when each sparking event has terminated. In addition, an I-sense signal 68 is provided to the multicharge controller 54 to indicate how much current is flowing through the primary side of whichever one of the coils 58 is activated.

The multicharge controller 54 can be implemented using many different circuits. A preferred implementation of the multicharge controller 54, however, includes a state machine which is programmed or otherwise suitably configured to perform the functions described above with reference to FIGS. 1 and 2. A suitably programmed EPROM (electrically programmable read only memory), for example, can be used as the state machine. The multicharge controller 54 also can be implemented using a suitably programmed ASIC (application-specific integrated circuit).

Figure 6:
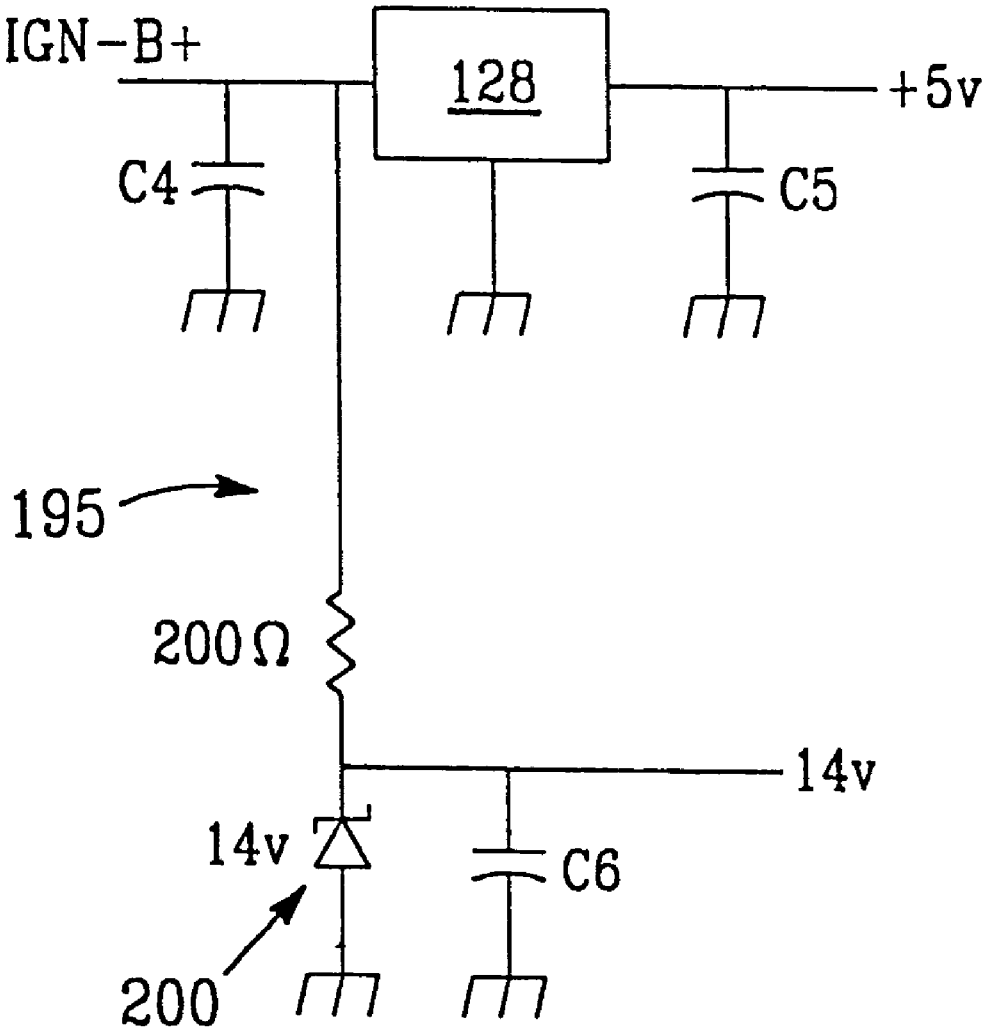
FIG. 6 is a schematic diagram of a voltage supply circuit in the exemplary implementation.
Figure 7:
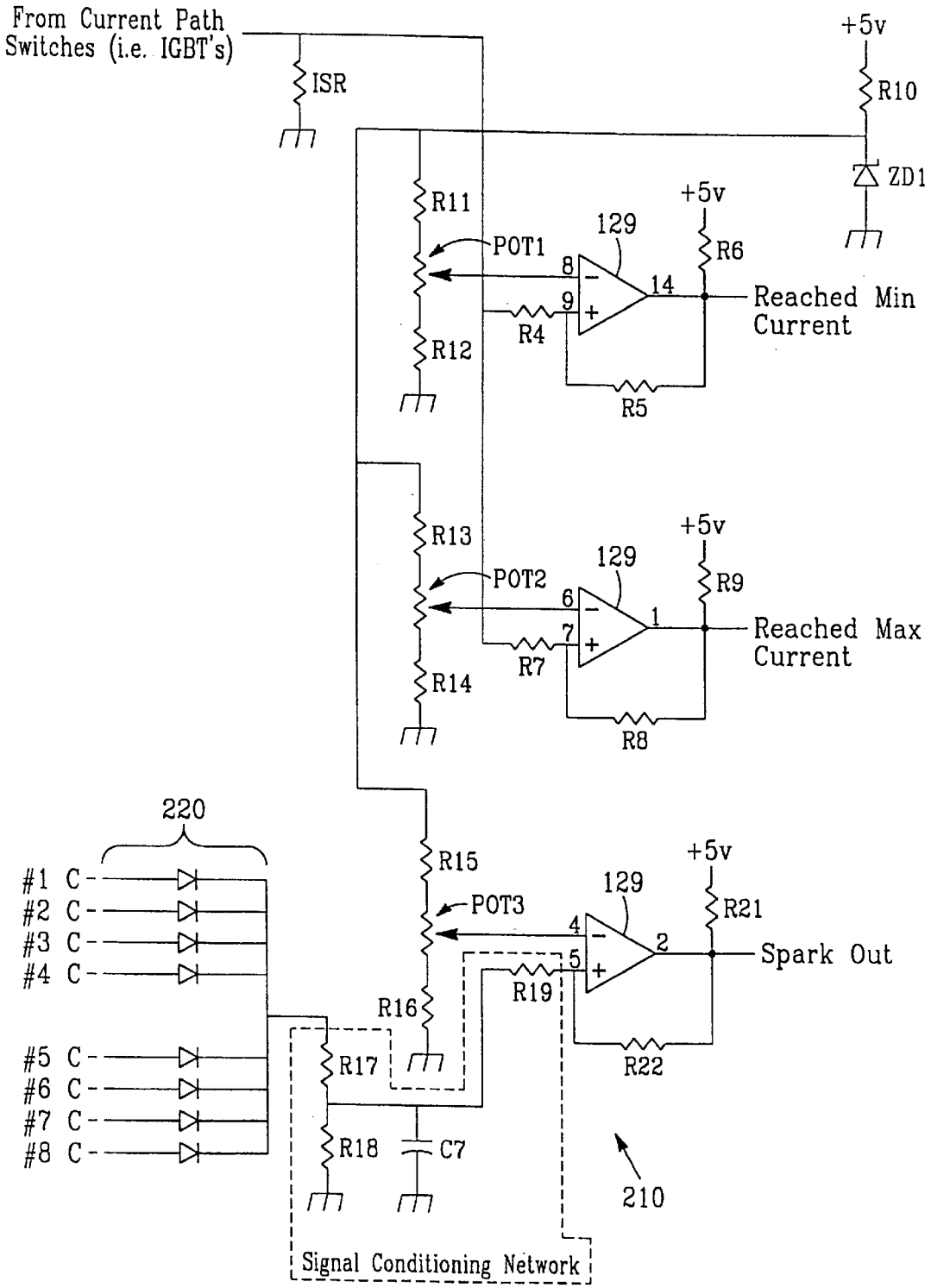
FIG. 7 is a schematic diagram of an interface in the exemplary implementation.
Figure 8:
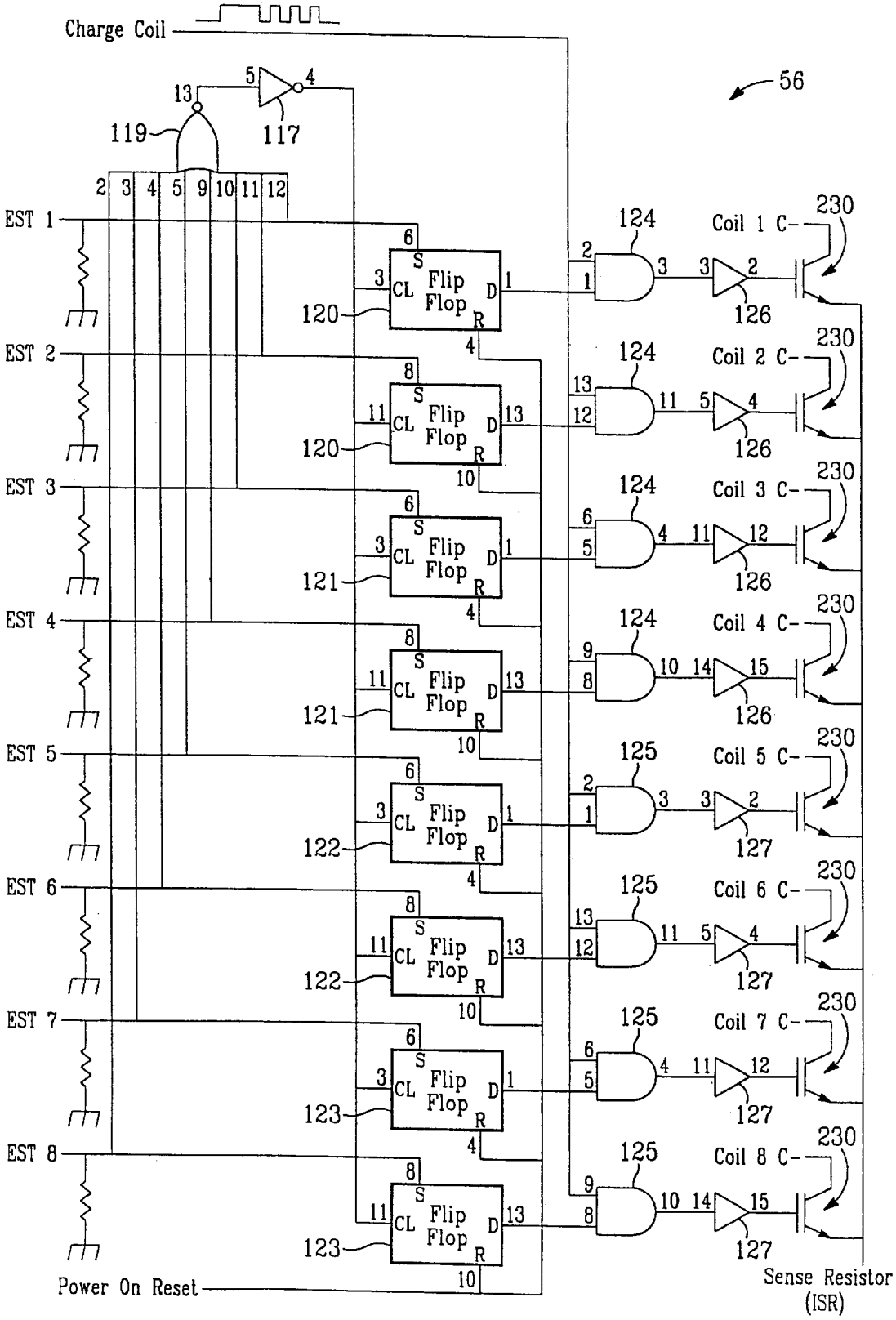
FIG. 8 is a schematic diagram showing an exemplary implementation of the driver array illustrated in FIG. 3.

FIGS. 4–7 illustrate an exemplary EPROM-based implementation of the multicharge controller 54, whereas FIG. 8 illustrates an exemplary driver array 56 for use in connection with the exemplary EPROM-based implementation.

Figure 4:
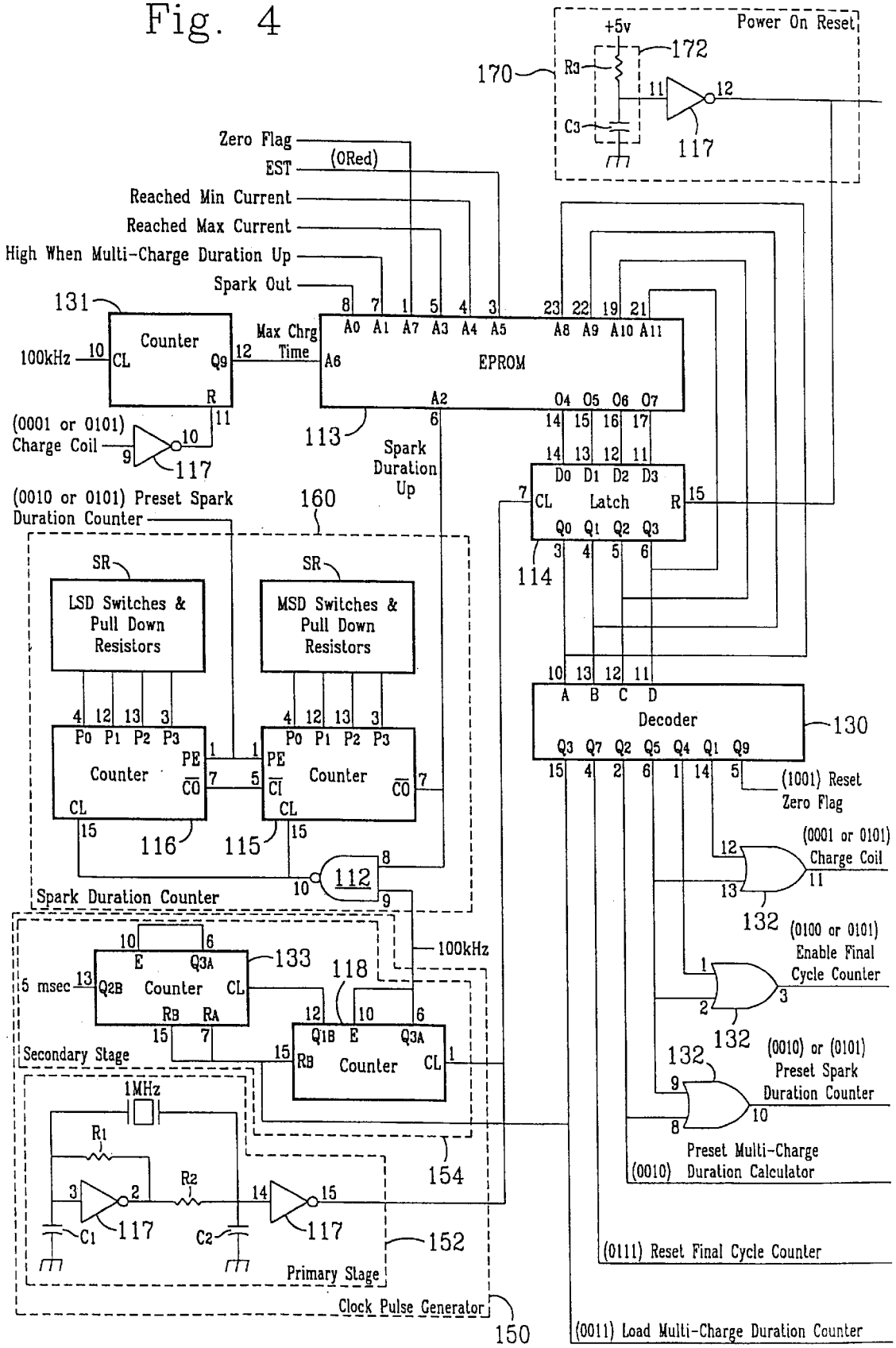
FIG. 4 is a schematic diagram of an EPROM and some of its associated circuitry in an exemplary implementation of the multicharge controller illustrated in FIG. 3.
Figure 5:
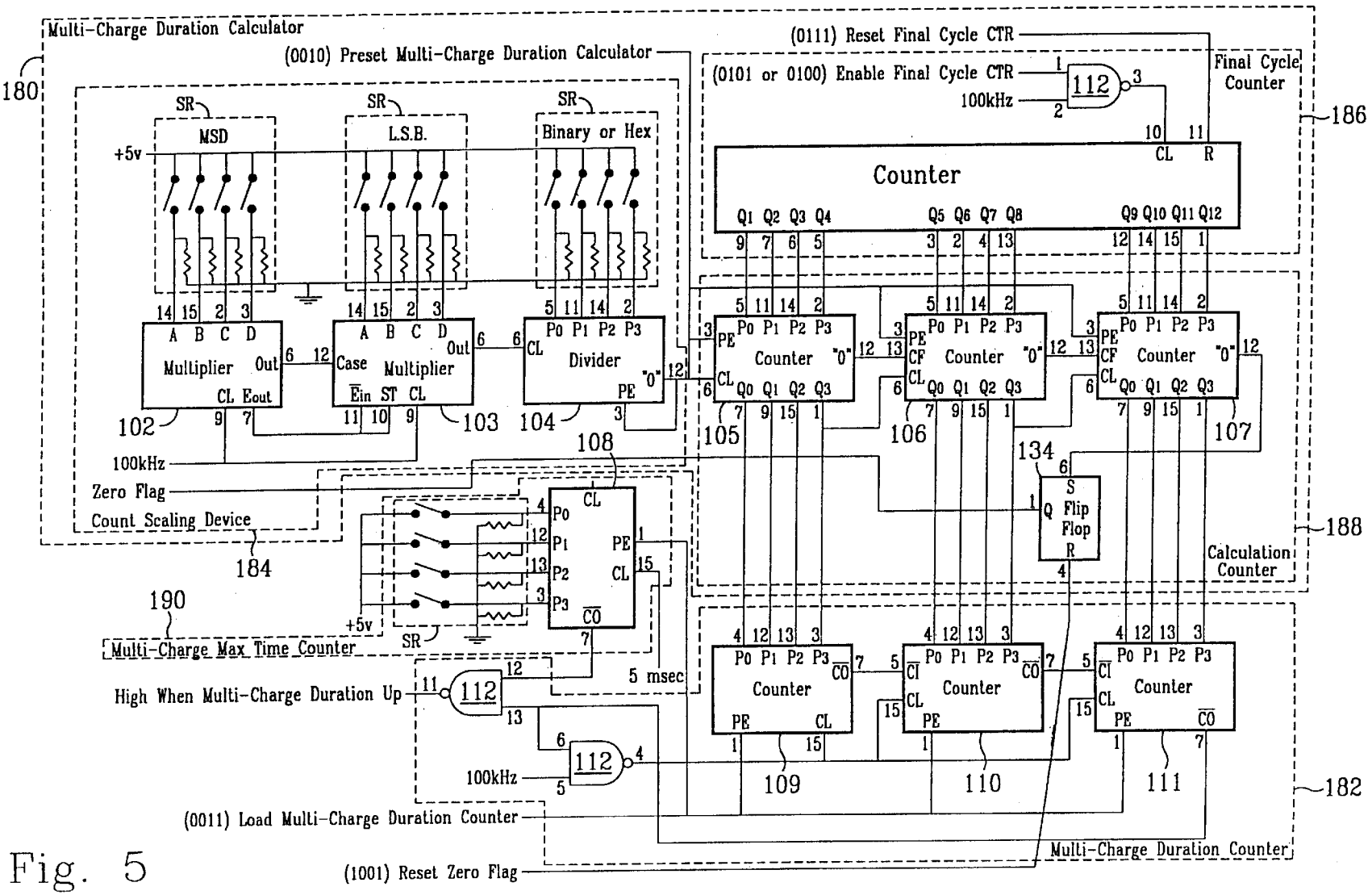
FIG. 5 is a schematic diagram of a multicharge duration calculator and counter in the exemplary implementation.

More specifically, FIG. 4 illustrates a suitably programmed EPROM 100 and some of its associated circuitry. FIG. 5 illustrates a multicharge duration calculator and counter which the EPROM 100 uses to determine when the multicharge duration terminates. FIG. 6 illustrates a voltage supply circuit for the EPROM-based implementation. FIG. 7 illustrates an interface of the EPROM-based implementation.

The interface in FIG. 7 is adapted to provide the EPROM 100 with input signals indicative of whether the spark at the spark plug has become extinguished (i.e., a SPARK OUT signal), whether the current through a primary winding has exceeded a predetermined minimum number of amperes (e.g., 15 amperes) (i.e., a REACHED MIN CURRENT signal), and whether the current through the primary winding has exceeded a predetermined maximum number of amperes (e.g., 20) (i.e., a REACHED MAX CURRENT signal).

The following chart correlates the reference numbers of the various logic components in FIGS. 4–8 with the commonly known numerical designations of certain exemplary integrated chips (ICs) which can be used to implement such components. The numerical designations are consistent with those that are published by National Semiconductor Corporation, a supplier of such ICs. The following chart also indicates which pins of the respective ICs are connected to ground, which are connected to a +5 v DC voltage, and which are connected to a +14 v DC voltage. The other relevant pin connections are shown in FIGS. 5–8 using the pin designations that are well-recognized in the art for each of the exemplary ICs:

| Ref. No. | Part No. | Grounded Pins | 5 Volt Pins | 14 Volt Pins | Description |
|---|---|---|---|---|---|
| 100 | 2732 | 12,18,20 | 24 | | EPROM |
| 101 | 4040 | 8 | 16 | | 12-Stage Binary Counter |
| 102 | 4527 | 4,8,10–13 | 16 | | BCD Rate Multiplier |
| 103 | 4527 | 4,8,13 | 16 | | BCD Rate Multiplier |
| 104 | 4526 | 4,8,10 | 13,16 | | Programmable Divide-by-N, 4-Bit Binary Counter |
| 105 | 4526 | 4,8,10 | 13,16 | | Programmable Divide-by-N, 4-Bit Binary Counter |
| 106 | 4526 | 4,8,10 | 16 | | Programmable Divide-by-N, 4-Bit Binary Counter |
| 107 | 4526 | 4,8,10 | 16 | | Programmable, Divide-by-N, 4-Bit Binary Counter |
| 108 | 4516 | 5,8,9,10 | 16 | | Binary Up/Down Counter |
| 109 | 4516 | 5,8,9 | 10,16 | | Binary Up/Down Counter |
| 110 | 4516 | 8,9 | 10,16 | | Binary Up/Down Counter |
| 111 | 4516 | 8,9 | 10,16 | | Binary Up/Down Counter |
| 112 | 4011 | 7 | 14 | | Quad Two-Input NAND Buffered Gate |
| 114 | 4076 | 1,2,8–11 | 16 | | TRI-STATE ® Quad D Flip-Flop |
| 115 | 4516 | 8,9,10 | 16 | | Binary Up/Down Counter |
| 116 | 4516 | 5,8,9,10 | 16 | | Binary Up/Down Counter |

-continued

| Ref. No. | Part No. | Grounded Pins | 5 Volt Pins | 14 Volt Pins | Description |
|---|---|---|---|---|---|
| 117 | 4049 | 7,8 | 1 | | Hex Inverting Buffer |
| 118 | 4518 | 7,8,9 | 2,16 | | Dual Synchronous Up Counter |
| 119 | 4078 | 7 | 14 | | Inverter |
| 120 | 4013 | 5,7,9 | 14 | | Dual D Flip-Flop |
| 121 | 4013 | 5,7,9 | 14 | | Dual D Flip-Flop |
| 122 | 4013 | 5,7,9 | 14 | | Dual D Flip-Flop |
| 123 | 4013 | 5,7,9 | 14 | | Dual D Flip-Flop |
| 124 | 4081 | 7 | 14 | | Quad Two-Input AND Buffered Gate |
| 125 | 4081 | 7 | 14 | | Quad Two-Input AND Buffered Gate |
| 126 | 4504 | 7,8,9 | 1 | 16 | Non-Inverting Buffer |
| 127 | 4504 | 7,8,9 | 1 | 16 | Non-Inverting Buffer |
| 128 | LM2930 | | | | Three-Terminal Positive Voltage Regulator |
| 129 | LM139 | 10–12 | 3 | | Precision Voltage Comparator with Low Offset Voltage |
| 130 | 4028 | 8 | 16 | | BCD-to-Decimal Decoder |
| 131 | 4040 | 8 | 16 | | 12-Stage Binary Counter |
| 132 | 4071 | 7 | 14 | | Quad Two-Input OR Buffered Gate |
| 133 | 4518 | 8,9 | 2,16 | | Dual Synchronous Up Counter |
| 134 | 4013 | 3,5,7–11 | 14 | | Dual D Flip-Flop |

The EPROM 100 includes twelve address terminals A0–A11 and four output terminals O4–O7. The address terminal A5 is connected to the ORed EST pulses from the EST separator 52. This enables the EPROM 100 to detect when the EST pulse undergoes transitions from high to low or from low to high.

The EPROM 100 is programmed to operate as a state machine. Depending on the of the signals at the address terminals A0–A11, the EPROM 100 goes from one state next, each state being represented by a binary number that the EPROM 100 places at put terminals O4–O7.

The address terminals A0–A4 are connected to a SPARK OUT signal, a HIGH WHEN MULTICHARGE DURATION UP signal, a SPARK DURATION UP signal, the REACHED MAX CURRENT signal, and the REACHED MIN CURRENT signal, respectively. Address terminals A6 and A7 are connected to a MAX CHARGE TIME signal and a ZERO FLAG signal, respectively.

The output terminals O4–O7 are connected to the respective data terminals D0–D4 of a latch 114. The corresponding outputs Q0–Q3 from the latch 114 are fed back as inputs to the address terminals A8–A11, respectively. The latch 114 holds the state of the state machine for a predetermined period of time.

Connected to the outputs Q0–Q3 of the latch 114 is the BCD-to-decimal decoder 130. The decoder 130 receives the binary code which represents the present state and, in response thereto, provides a high signal on one of its outputs Q1–Q9. Each high signal is then used to trigger an event or operation dictated by the particular state. These high signals therefore work as control signals for the ignition process carried out by the exemplary implementation. Since some of the control signals are required in more than one state, some of the outputs Q1–Q9 from the decoder 130 are logically ORed using OR gates from the aforementioned Quad OR gate 132.

The exemplary implementation also includes a clock pulse generator 150. The clock pulse generator 150 includes a primary stage 152 and a secondary stage 154. The primary stage 152 includes a 1 MHz oscillator, the inverters 119 and conventional signal conditioning resistors R1,R2 and capacitors C1,C2. The resistors R1 and R2 have resistances of about 2.2 M ohm and 1 k ohm, respectively. Each of the capacitors C1,C2 has a capacitance of about

47p Farad. The clock signal output from the primary stage 152 is applied to the clock terminal of the latch 114. It also is applied to the secondary stage 154.

The secondary stage 154 is responsive to the clock signal output from the primary stage 152 and includes frequency division elements adapted to provide a 100 kHz clock signal and a 5 millisecond clock signal in response to the clock signal output from the primary stage 152. The frequency division elements are provided using the aforementioned dual synchronous up counters 118 and 133.

Connected to the 100 kHz clock signal is a spark duration counter 160. The spark duration counter 160 determines how much time will elapse between opening of the current path through the primary winding at the beginning of a partial discharge and closing of the same path at the end of a partial discharge. This corresponds to the aforementioned predetermined period of time T.

The spark duration counter 160 is a two-digit counter defined by the combination of individual binary up/down counters 115 and 116 and the NAND gate 112. A suitable arrangement of switches and pull-down resistors SR is provided at the preset terminals P0–P3 of each counter 115,116. The switches can be used to provide a preset least significant digit and a preset most significant digit. The combination of the least and most significant digits defines the starting point of the counting operation performed by the spark duration counter 160. This starting point is selected so that, after counting begins, it takes the predetermined period of time T for the counter 115 to produce a carry-over signal at its carry-over terminal. Since counting by the spark duration counter 160 begins as soon as the current path through the primary winding is opened, the carry-over signal serves as the aforementioned SPARK DURATION UP signal. It therefore is applied to the A2 address terminal of the EPROM 100. The SPARK DURATION UP signal thereby indicates to the EPROM 100 when the predetermined period of time T has elapsed since opening of the current path through the primary winding.

The switches preferably are rotary switches, dip switches, or the like. By selectively setting the switches that determine the least and most significant digits, it is possible to adjust the predetermined period of time T provided by the spark duration counter 160. Thus, variations is system design, as well as variations in the amount of energy that will be discharged during each of the partial discharges of the coil, can be accommodated in a convenient manner by the exemplary implementation.

Also illustrated in FIG. 4 is a POWER-ON reset circuit 170. The POWER-ON reset circuit 170 includes an RC circuit 172 connected to the input of the aforementioned buffer 117. The RC circuit 172 includes a resistor R3 having a resistance of about 150 k ohms and a capacitor C3 having a capacitance of about 0.1 Farad. The POWER-ON reset circuit 170 is configured to provide a reset signal whenever system power is initially applied.

FIG. 4 also illustrates the 12-stage binary counter 131. The counter 131 limits the charging time of the coil. More specifically, the counter 131 provides the aforementioned MAX CHARGE TIME signal to the EPROM 100 when the current path through the primary winding has been closed for a maximum period of time. When this occurs, the EPROM 100 responds by switching to a state wherein the current path through the primary winding is open. This, in turn, causes the energy in the coil to be at least partially discharged through the appropriate spark plug.

The predetermined period of time is determined by which output (Q1, Q2 . . . or Q14) from the counter 131 is connected to the A6 address terminal of the EPROM 100. The higher the Q-number of the terminal the longer the period of time. In the preferred implementation, the Q9 output terminal of the counter 131 is connected to the A6 address terminal to provide a maximum charge time of about 2.5 milliseconds.

The counter 131 is automatically reset by the inverse of the CHARGE COIL signal. In particular, the CHARGE COIL signal passes through inverting buffer 117, is inverted by the buffer 117, and the resulting inverted version of the CHARGE COIL signal is applied to the reset terminal of the counter 131. The counter 131 therefore is reset automatically whenever the coil is not being charged.

FIG. 5 illustrates the multicharge duration calculator 180 and multicharge duration counter 182. As indicated above, the multicharge duration calculator 180 and multicharge duration counter 182 are used by the EPROM 100 to determine when the multicharge duration terminates.

Preferably, the multicharge duration calculator 180 includes a count scaling device 184, a final cycle counter 186, and a calculation counter 188. The count scaling device 184 includes the BCD rate multipliers 102,103 and the programmable divide-by-N binary counter 104.

Each of the BCD rate multipliers 102,103 and the programmable divide-by-N binary counter 104 is connected to a set of pull-down resistors and switches SR (e.g., rotary switches, dip switches, and the like). The switches are selectively positioned to provide a desired number code to the inputs of the respective multipliers 102,103 and the counter 104.

The number code at the inputs to the multipliers 102,103 determines the scaling factor provided by the multipliers 102,103. The scaling factor is 0.XY, wherein X (the most significant digit) is determined by the number code at the input to the multiplier 102, and Y (the least significant digit) is determined by the number code at the input to the multiplier 103. The multipliers 102,103 receive the 100 kHz clock signal and scale the clock rate by the indicated scaling factor. Exemplary relationships between the scaling factor and the degrees of engine rotation are provided in the above chart.

For a desired spark duration of twenty degrees, for example, the scaling factor is 0.11 for a 4-cylinder engine, 0.17 for a 6-cylinder engine, and 0.22 for an 8-cylinder engine. Thus, for the 6-cylinder example, the number code at the multiplier 102 would be 1 and the number code at the multiplier 103 would be 7.

The programmable divide-by-N binary counter 104 has its input set to 1 whenever all of the EST pulses (i.e., the EST pulses for all cylinders) are delivered to and ORed by the exemplary multicharge controller 54 as it counts the time between such EST pulses and determines the spark duration based on this count. This is so because the scaling factor in the above chart assumes that all of the EST pulses are used in making the determination of spark duration. The clock rate provided by the multipliers 102,103 therefore requires no frequency correction when all of the EST pulses are used.

In situations where there is no desire to make the multicharge duration calculator 180 adaptable to different numbers of combustion chambers, the appropriate scaling factor from the foregoing chart can be loaded into the multipliers 102,103, and the counter 104 can be eliminated.

If it becomes desirable to use the EST pulses from less than all of the cylinders, then a corresponding correction in the clock rate can be achieved by changing the input to the counter 104. When the EST pulses, for example, of only one cylinder in an 4-cylinder engine are used by the multicharge controller 54 to make the aforementioned determination, the input of the counter 104 can be set to a binary four (0100), thereby dividing the clock rate at the "O" output of the counter 104 by four. This advantageously compensates for the longer time between the successive EST pulses. In the context of 6-cylinder engines and 8-cylinder engines, input codes of binary six (0110) and binary eight (1000), respectively, can be used to make the same kind of correction to the clock rate.

The counter 104 thereby provides a convenient way of adapting the multicharge controller 54 to changes in how the EST pulse is provided and how many cylinders the particular engine has. The multipliers 102,103 likewise provide a convenient way of setting the number of degrees of engine rotation per spark duration, which setting can be conveniently changed by merely changing the inputs to the multipliers 102,103 and thereby adjusting the scaling factor. The count scaling device 184 therefore makes the multicharge controller 54 universally adaptable to many different engine and PTCU configurations.

The clock rate used by the calculation counter therefore is appropriately scaled by the count scaling device 184. In addition, the calculation counter 188 is provided with a negative number by the final cycle counter 186. This negative number corresponds to the time it took (LAST RECHARGE+FULL DISCHARGE in FIG. 1) for the coil to be recharged and completely discharged at the end of a previous firing sequence of the same or a different spark plug. The final cycle counter 186 determines this negative number by counting the clock pulses which occurred in the presence of the ENABLE LAST CYCLE COUNTER signal during the preceding recharge and complete discharge cycle.

The calculation counter 188 therefore counts up from the negative number (which is preset in response to the PRESET MULTICHARGE DURATION CALCULATOR signal) at the rate determined by the count scaling device 184. The result of this counting is loaded into the multicharge duration counter 182 in response to the LOAD MULTICHARGE DURATION COUNTER signal. The multicharge duration counter 182 therefore is preset with a number corresponding to the appropriately scaled down time between EST pulses (i.e., scaled according to the number of degrees of engine rotation during which sparking is to occur) minus the time it takes for the coil to recharge and then completely discharge. The time represented by this preset number thus corresponds to a prediction of the multicharge duration MCD shown in FIG. 1. This prediction is relatively accurate because it is based on the actual time elapsed during a previous sequence of multicharging and then completely discharging, which elapsed time does not change significantly from one firing sequence to the next.

In order to ensure that the repetitive closings and reopenings of the current path are not carried out when the calculation counter 188, in determining the present number in the multicharge duration counter 182, had failed to reach a count of at least zero, the "ZERO" terminal of the calculation counter 188 is connected to the S terminal of the flip-flop 134. The Q terminal of the flip-flop 134 is connected to the A7 address terminal of the EPROM 100. The EPROM 100 thereby is provided with the aforementioned ZERO FLAG signal and is able to determine from that signal whether counting by the calculation counter 188 had at least reached zero (i.e., whether the count had reached a non-negative number). If counting had not reached zero, the EPROM 100 precludes the repetitive closing and reopening of the current path through the primary winding which otherwise would have been erroneously performed based on the multicharge duration period derived from a non-zero-reaching count.

In order to permit resetting of the ZERO FLAG signal, the R terminal of the flip-flop 134 is connected to a RESET ZERO FLAG signal that is driven high by the decoder 130 whenever the corresponding reset code is provided by the EPROM 100 at its output terminals O4–O7.

Normally, counting by the multicharge duration counter 182 continues in response to the 100 kHz clock signal until the end of the multicharge duration MCD (shown in FIG. 1) is reached. At the end of the multicharge duration count, the multicharge duration counter 182 causes the MULTICHARGE DURATION UP signal to go high. This, in turn, indicates to the EPROM 100 that the end of the desired spark duration is near and that no more partial discharges of the relevant coil are to occur and that recharging of the coil is not to begin (although recharging can continue if it has already started). The EPROM 100 thus switches to the state which directs the next discharge of the coil to be a complete discharge, not a partial discharge. In particular, the current path which had been repetitively closed at the predetermined current threshold IT and reopened for only the predetermined period of time T, is now kept open after the predetermined current threshold IT is reached to facilitate complete discharging of the relevant coil. The complete discharging, of course, will take longer than the predetermined period of time T.

The resulting operation provides a close relationship between the desired spark duration in degrees of engine rotation, and the actual spark duration in degrees of engine rotation. In particular, the scaling of the time between EST pulses provides a reliable prediction of the actual sparking duration, in units of time, required to provide sparking during the predetermined number of degrees of engine rotation (e.g., about 20 degrees). This prediction of the actual sparking time then is used to determine the end of the multicharge duration MCD. In particular, this determination is made using information regarding how long the final "recharge and complete discharge" cycle lasted in an immediately preceding firing cycle. That information, in turn, provides a reliable prediction of how long the upcoming final "recharge and complete discharge" cycle will last. Thus, the duration of the preceding final recharge and complete discharge cycle is subtracted (or made negative and added) to the predicted duration of the spark, in units of time, which was determined by scaling the time (or number of clock pulses) between the EST pulses. At the end of the predicted multicharge duration MCD, therefore, the current path through the primary side of the ignition coil is kept from performing partial discharges. In particular, once the predetermined current threshold IT is reached, the path through the primary side is opened but does not reclose within the time period T. The final recharging and discharging cycle therefore results in a complete discharge of the energy in the coil. Notably, this final recharge and discharge sequence terminates very close to the end of the desired spark duration DSD and thus very close to the end of the desired amount of engine rotation.

In most situations, it is not desirable for the spark duration to continue beyond a predetermined maximum period of time, regardless of engine speed. Accordingly, a multicharge maximum time counter 190 can be provided to automatically cause the MULTICHARGE DURATION UP signal to go high regardless of the count reached by the multicharge duration counter 182. An exemplary maximum time for the spark duration is about 5 milliseconds. This maximum time typically will come into play only at very low engine speeds, such as during cranking of the engine.

In the exemplary multicharge controller 54, the binary up/down counter 108 serves as part of the multicharge maximum time counter 190. In particular, the pull-down resistors and switches SR at the preset inputs P1–P3 of the counter 108 are set to a predetermined value that, in response to the 5 millisecond clock signal at the clock terminal CK, causes the MULTICHARGE DURATION UP signal to go high when the predetermined maximum period of time has elapsed. Notably, the LOAD MULTICHARGE DURATION COUNTER signal is connected to the PE terminal of the counter 108. The counter 108 therefore is automatically preset, along with the multicharge duration counter 182.

While a counter-based arrangement is disclosed in the foregoing exemplary implementation, it is understood that alternative implementations can be provided in which the functions carried out by the foregoing counters are performed by analog integrators instead of counters. This would be especially desirable in the context of an analog alternative implementation of the foregoing exemplary implementation.

FIG. 6 illustrates a preferred voltage supply circuit 195, including the three-terminal positive voltage regulator 128, a 14 volt zener diode 200, and three filtering capacitors C4,C5,C6. The capacitors C4–C6 have capacitances of about 0.1 Farad, 10 micro Farad, and 10 micro Farad, respectively. The voltage supply circuit 195 is adapted to provide relatively stable sources of voltage at the desired 5 volt and 14 volt levels.

As indicated above, FIG. 7 illustrates an interface 210 of the exemplary EPROM-based implementation. The interface in FIG. 7 is adapted to provide the EPROM 100 with the SPARK OUT signal, the REACHED MIN CURRENT signal, and the REACHED MAX CURRENT signal.

The interface 210 includes a current sense resistor (e.g., 0.05 ohm) ISR. The current sense resistor ISR is connected between ground and the switches (e.g., IGBTs described hereinafter) that selectively complete the current path through the primary windings of the coils. The current flowing through the primary windings therefore must pass through the current sense resistor ISR. The current sense resistor ISR thus provides a voltage indicative of the amount of current flowing through the active primary winding whenever one of the switches is closed.

A suitable network of resistors is provided to divide the current-indicative voltage from the current sense resistor ISR into voltages of acceptable magnitude at the non-inverting input terminals of upper two comparators 129 in FIG. 7. The network of resistors includes resistors R4–R9, some of which are arranged to provide feed-back from the output of the upper two comparators 129. Exemplary resistances of the resistors R4–R9 are set forth in the following chart:

| Reference Number | Resistance |
|---|---|
| R4 | 5k ohms |
| R5 | 5 meg ohms |
| R6 | 3k ohms |
| R7 | 5k ohms |
| R8 | 5 meg ohms |
| R9 | 3k ohms |

In addition, each of the inverting inputs of the comparators 129 in FIG. 7 is connected to a respective reference voltage. The reference voltages are provided with an appropriate magnitude by a 5 v voltage source, a zener diode ZD1 (providing a regulated voltage of about 3.6 volts), and a network of voltage dividing resistors R10–R16 and potentiometers POT1,POT2,POT3. The potentiometers POT1–POT3 preferably are 100 ohm potentiometers, and are adjusted to provide the reference voltages of appropriate magnitude. Exemplary resistances for the resistors R10–R16 are set forth in the following chart:

| Reference Number | Resistance |
|---|---|
| R10 | 100 ohms |
| R11 | 750 ohms |
| R12 | 150 ohms |
| R13 | 680 ohms |
| R14 | 220 ohms |
| R15 | 240 ohms |
| R16 | 620 ohms |

The upper-most comparator 129 in FIG. 7 has its output connected to the A4 address terminal of the EPROM 100. When the current-indicative voltage of the current sense resistor ISR indicates that the current through the primary winding has achieved the predetermined current threshold IT (e.g., 15 amperes), the voltages at the respective input terminals of the upper-most comparator 129 in FIG. 7 cause a transition in the output signal (i.e., the REACHED MIN CURRENT signal) of that particular comparator 129, which transition is applied to the A4 address terminal of the EPROM 100. The EPROM 100 thereby detects when the current level through the primary winding reaches the predetermined current threshold IT.

Similarly, the output terminal of the middle comparator 129 in FIG. 7 is connected to the A3 address terminal of the EPROM 100. When the current-indicative voltage of the current sense resistor ISR indicates that the current through the primary winding has achieved a predetermined maximum fault current (e.g., 20 amperes), the voltages at the respective input terminals of the middle comparator 129 in FIG. 7 cause a transition in the output signal (i.e., the REACHED MAX CURRENT signal) of that particular comparator 129, which transition is applied to the A3 address terminal of the EPROM 100. The EPROM 100 thereby detects when the current flow through the primary winding reaches the predetermined maximum fault current.

The lower-most comparator 129 in FIG. 7 has its non-inverting input terminal connected, indirectly through a signal conditioning network 215 of resistors R17–R19 and a capacitor C7, to a rectified voltage from the negative terminal of each coil. The rectification is provided by a diode array 220. The resistors R17–R19 have exemplary resistances of about 900 ohms (1%), 100 ohms (1%), and 5 k ohms, respectively. The capacitor C7 has an exemplary capacitance of about 0.01 Farad.

The output from the lower-most comparator 129 in FIG. 7 is connected, through a resistor R21 (e.g., a 3 k ohm resistor), to the 5 v voltage source. In addition, feedback from the output of the lower-most comparator 129 is provided by connecting a resistor R22 (e.g., a 1 meg ohm resistor) between the output and non-inverting input terminals of the lower-most comparator 129. The resulting configuration of the diode array 220 and the signal conditioning network 215 causes the lower-most comparator 129 in FIG. 7 to produce a SPARK OUT signal that goes low whenever discharging of energy across the spark plug gap has terminated.

With reference to FIG. 8, a preferred implementation of the driver array 56 will be described. The preferred implementation includes the aforementioned switches in the primary winding paths, which switches are denoted using reference numeral 230. A switch 230 is provided for each primary winding and is connected to the negative terminal of that primary winding. Connected between all of the switches 230 and the electrical ground is the aforementioned current sense resistor ISR.

The switches 230 preferably are implemented using IGBTs (insulated gate bipolar transistors), as shown in FIG. 8. The gate of each IGBT switch 230 is connected to the output of a respective non-inverting buffer 126 or 127. Each non-inverting buffer 126 or 127 is driven by the output of an AND gate (of quad AND gate 124 or 125). Each of the AND gates 124,125 has one input connected to the CHARGE COIL signal and its other input connected to the D terminal of a flip-flop 120, 121, 122, or 123. The S terminal of each flip-flop 120–123 is connected to a respective one of the separated EST signals 62 from the EST separator 52. The CL terminal of each flip-flop 120–123, by contrast, is connected to a signal that goes high whenever any one of the separated EST signals 62 is high. Each flip-flop 120–123 therefore drives its output high in response to its respective EST signal being high, and keeps its output high until another EST signal goes high. The array of flip-flops 120–123 therefore serves as a latch indicating which of the EST pulses was most recently applied.

The preferred implementation of the driver array 56 thus "enables" closure of only the switch(es) 230 that are associated with the most recent of the separated EST pulses. The other switches 230 cannot be closed. The fact that a particular switch 230 is associated with the most recent EST pulse, however, does not mean that that particular switch 230 will remain closed during the entire period of time before another EST pulse is applied. To the contrary, because of the ANDing function carried out by the AND gates 124,125, the "enabled" one or group of switches 230 will close only when the CHARGE COIL signal indicates that it (or they) is (are) to close. Current therefore flows through the primary windings only in the coil(s) corresponding to the last EST pulse and only while the CHARGE COIL signal is high.

As illustrated in FIG. 8, the signal that goes high when any one of the separated EST signals 62 goes high, is generated by connecting the inputs of the inverting OR gate 119 to respective ones of the separated EST signals 62, and by connecting the output of the inverting OR gate 119 to the inverting buffer 117.

The preferred implementation of the driver array 56 shown in FIG. 8 advantageously can be used with as many as eight different combustion chambers firing at different times. It also can be used with fewer combustion chambers. The multicharge controller 54 shown in FIGS. 4–7, for example, is adapted for use in the context of a 4-cylinder engine. That same multicharge controller 54 is compatible with the exemplary driver array 56 in FIG. 8, and in fact, can operate using about half of the circuitry illustrated in FIG. 8. In order to use the driver array 56 illustrated in FIG. 8 along with the exemplary multicharge controller 54, only four of the flip-flops 120–123, four of the AND gates 124,125, four of the non-inverting buffers 126,127, and four of the IGBT switches 230 are used. In particular, the four separated EST signals 62 are connected to four of the S terminals of the four flip-flops 120–123, respectively, and the four coils 58 are connected to the corresponding four of the IGBT switches 230, respectively. The CHARGE COIL signal then is applied to the four AND gates 124 or 125 that are connected to outputs from the four flip-flops 120,121,122 or 123. As a result, the exemplary driver array 56 selectively controls whether current is able to flow through the primary winding of the coil 58 selected by the most recent EST pulse, and performs this selective control in a manner dependent upon whether the CHARGE COIL signal from the multicharge controller 54 is high. The EPROM 100, via the CHARGE COIL signal, thus controls the sparking sequence in each combustion chamber so that it occurs substantially as illustrated in FIG. 1.

Figure 9:
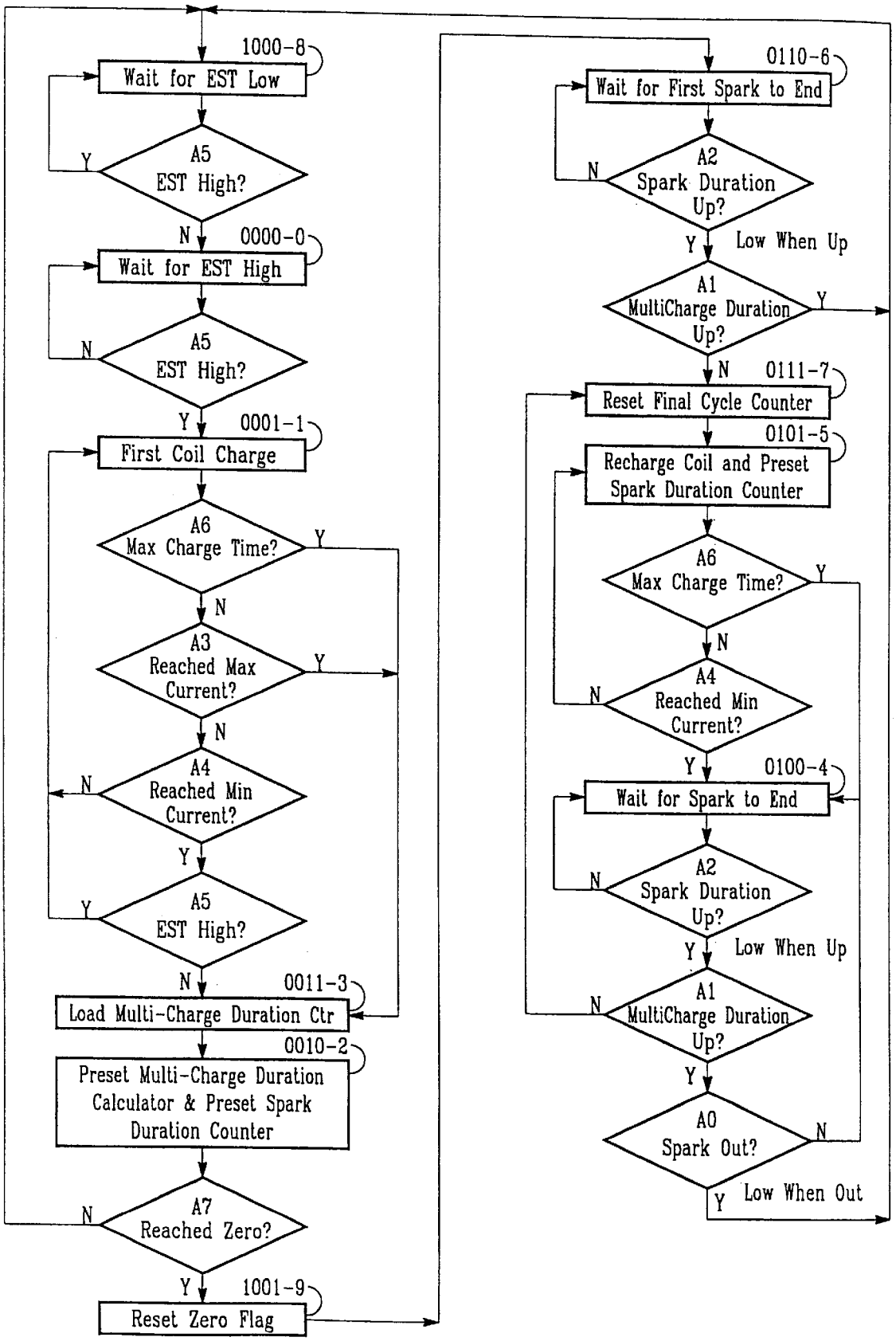
FIG. 9 is a flow chart of a program that the EPROM in FIG. 4 executes according the exemplary implementation.

FIG. 9 is a flow chart of the program that the EPROM 100 executes. In FIG. 9, the reference numerals that designate the various states of the state machine embodied by the EPROM 100 are provided in the form of XXXX-N, wherein the "XXXX" are the "1"s and "0"s that make up a four-bit binary representation of the state and wherein "N" is the decimal number identified with that state. The four-bit binary number is what appears at he output terminals O4–O7 of the EPROM 100 when the EPROM 100 is in the state represented by the binary number in FIG. 9.

FIG. 9 also includes an address terminal designation (e.g., A0, A1, . . . A7) in each decision block. Each address terminal designation indicates which address terminal provides the EPROM 100 with the information it uses in making the determination represented by that decision block.

Initially, in State 1000-8, the EPROM 100 waits for the EST signal to be low. It does this by monitoring its A5 address terminal. Once the EST signal is low, the EPROM 100 switches to State 0000-0 and waits for the EST signal to go high again. It does this by continuing to monitor its A5 address terminal.

When the EST signal goes high, the EPROM 100 responds by switching to State 0001-1. In State 0001-1, the EPROM 100 directs the Q1 output from the decoder 130 to go high and thereby causes the CHARGE COIL signal to go high. In response, the driver array 56 closes the appropriate one of the IGBT switches 230 and the flow of current begins to increase through the associated primary winding. Charging of the appropriate coil thus commences. By waiting (in State 1000-8) for the EST signal be low before charging the activated coil, the EPROM 100 advantageously ensures that charging will occur only in response to a complete EST pulse, rather than a partial EST pulse.

In State 0001-1, the EPROM 100 monitors its A6 and A3 address terminals, as charging of the coil continues. If the MAX CHARGE TIME signal or the MAX CURRENT REACHED signal at the A6 or A3 address terminal, respectively, of the EPROM 100 goes high while the coil is being charged, the EPROM responds by switching to State 0011-3. If the signals at the A6 and A3 address terminals remain low, the EPROM 100 checks for the REACHED MIN CURRENT signal at its A4 address terminal to determine whether the predetermined current threshold IT has been reached. If the predetermined current threshold IT has not been reached, charging of the coil continues, and the EPROM 100 continues to monitor its A6, A3, and A4 address terminals. If the REACHED MIN CURRENT signal, however, indicates that the predetermined current threshold IT has been reached, the EPROM 100 waits for the EST signal to go low. In particular, the EPROM monitors its A5 address terminal for the trailing edge of the EST pulse. When the EST signal goes low, the EPROM 100 responds by switching to State 0011-3.

In State 0011-3, the first discharge of the selected coil 58 through the respective spark plug 60 commences. More specifically, the EPROM 100 applies the "0011" code to its output terminals O4–O7, which code is then latched by the latch 114 and applied to the decoder 130. The decoder 130 responds by driving its Q3 output high, and by driving low its other outputs (Q0–Q2, Q4, Q5, Q7, and Q9). This causes the LOAD MULTICHARGE DURATION COUNTER signal to go high. In addition, because the Q5 output from the decoder 130 is low, the CHARGE COIL signal is absent, thereby causing the current path through the primary winding to open. State 0011-3 thus causes the first spark discharge to begin and causes the value at the output from the calculation counter 188 to be loaded into the multicharge duration counter 182 as a preset value.

The EPROM 100 then switches to State 0010-2. In State 0010-2, the PRESET SPARK DURATION COUNTER signal and the PRESET MULTICHARGE DURATION CALCULATOR signal are set high. The spark duration counter 160 responds to this high signal by loading the value indicative of the predetermined period of time T as a preset value. Likewise, the multicharge duration calculator 180 responds to the PRESET MULTICHARGE DURATION CALCULATOR signal by presetting the calculation counter 188 with the aforementioned negative number from the final cycle counter 186.

The EPROM 100 then checks its A7 address terminal to determine whether the ZERO FLAG signal has been set by the flip-flop 134. If the ZERO FLAG signal has not been set, the EPROM 100 returns to step 1000-8 and waits for the next EST pulse. If the ZERO FLAG signal has been set, thereby indicating that a non-negative value had been reached by the calculation counter 188, the EPROM 100 responds by switching to State 1001-2. In State 1001-2, the EPROM 100 causes the Q9 output of the decoder 130 to go high. Since the Q9 output of the decoder 130 is connected to the R terminal of the flip-flop 134, the ZERO FLAG signal is reset as a result of State 1001-2.

The EPROM 100 then switches to State 0110-6. In State 0110-6, the coil continues discharging while the SPARK DURATION UP signal is monitored at the A2 address terminal of the EPROM 100. When the SPARK DURATION UP signal drops low, indicating that the predetermined period of time T has elapsed, the EPROM 100 checks its A1 address terminal to determine whether the MULTICHARGE DURATION UP signal has gone high. If the MULTICHARGE DURATION UP signal has gone high, the EPROM 100 responds by switching to State 1000-8 and waiting for another EST pulse (e.g., an EST pulse corresponding to the next combustion chamber or cylinder in the firing order) by monitoring its A5 address terminal.

If the MULTICHARGE DURATION UP signal at the A2 address terminal remains low when the SPARK DURATION UP signal goes low, indicating that the predicted multicharge duration has not expired, the EPROM 100 responds by switching to State 0111-7. In State 0111-7, the final cycle counter 186 is reset by the EPROM 100. In particular, the EPROM 100 causes the Q7 output terminal of the decoder 130 to go high. This high RESET FINAL CYCLE COUNTER signal at the Q7 output terminal of the decoder 130, in turn, is applied to the R terminal of the binary counter 101 and causes the counter 101 to reset.

The EPROM 100 next switches to State 0101-5. In State 0101-5, the EPROM 100 causes the Q5 output of the decoder 130 to go high. This, in turn, causes the CHARGE COIL signal, the ENABLE FINAL CYCLE COUNTER signal, and the PRESET SPARK DURATION COUNTER signal to all go high. Recharging of the coil therefore commences, as does counting by the final cycle counter 186. Since the previous discharge was limited by the predetermined period of time T, the recharging commences from a partially charged condition. The PRESET SPARK DURATION COUNTER causes the spark duration counter 160 to be loaded with the value that corresponds to the predetermined period of time T.

While charging of the coil continues in State 0101-5, the EPROM 100 monitors its A6 and A4 address terminals to determine whether the MAX CHARGE TIME signal or the REACHED MIN CURRENT signal, respectively, has gone high. The EPROM 100 continues to charge the coil and stays in State 0101-5 so long as both the MAX CHARGE TIME signal and the REACHED MIN CURRENT signal remain low.

When either of the MAX CHARGE TIME signal or the REACHED MIN CURRENT signal goes high, the EPROM 100 switches to State 0100-4. In State 0100-4, the EPROM 100 causes only the Q4 output terminal of the decoder 130 to go high. The high Q4 output causes the ENABLE FINAL CYCLE COUNTER signal to go high, thereby causing the final cycle counter 186 to begin counting again. Inasmuch as the Q4 terminal of the decoder 130 is the only high output from the decoder 130 in State 0100-4, the CHARGE COIL signal goes low, causing the activated coil 58 to begin discharging through its respective spark plug 60. Such discharging causes a spark to develop at the corresponding spark plug 60. The EPROM 100, during this spark generation process in State 0100-4, monitors its A2 to determine when the SPARK DURATION UP signal goes low.

After the spark duration counter 160 counts for the predetermined period of time T, the SPARK DURATION UP signal goes low. Based on the SPARK DURATION UP signal at its A2 address terminal, therefore, the EPROM 100 is able to detect when the predetermined period of time T has elapsed. When the predetermined period of time T has elapsed, the EPROM 100 determines whether the multicharge duration is over, by checking its A1 address terminal. The A1 address terminal of the EPROM 100 receives the MULTICHARGE DURATION UP signal. The MULTICHARGE DURATION UP signal goes high when the multicharge duration is over according to the multicharge duration counter 182 or according to the multicharge maximum time counter 190.

If the MULTICHARGE DURATION UP signal at the A1 address terminal is low when the SPARK DURATION UP signal at the A2 address terminal goes low, the EPROM 100 responds by returning to State 0111-7 and proceeding again through States 0101-5 and 0100-4. This process of going through States 0111-7, 0101-5, and 0100-4 is repeated by the EPROM 100 to provide multicharging of the activated coil 58 and multisparking at the corresponding spark plug 60.

The repetitions continue until the MULTICHARGE DURATION signal goes high during an iteration of State 0100-4.

When the MULTICHARGE DURATION signal is high in State 0100-4, the EPROM 100 remains in State 0100-4 (i.e., with the CHARGE COIL signal deactivated to prevent recharging and permit complete discharging of the coil) until the SPARK OUT signal at the A0 address terminal of the EPROM 100 goes low, indicating that the coil has been completely discharged (i.e., the spark is out). Only then does the EPROM return to State 1000-8 from State 0100-4.

Since the transition from State 0100-4 to State 1000-8 causes the ENABLE FINAL CYCLE COUNTER signal to go low, the final cycle counter 186 stops counting and is left holding the aforementioned negative value that corresponds to the duration of the final recharge and complete discharge cycle.

In State 1000-8, the EPROM 100 waits for the next EST pulse and repeats the process shown in FIG. 9 for the next EST pulse. Since the driver array 56, in response to the next EST pulse, automatically switches from one coil being active to the next, the next EST pulse causes the process of FIG. 9 to be implemented using a different coil 58 and spark plug 60 in the firing order of the engine. This overall process of applying the process shown in FIG. 9 to one coil 58 and spark plug 60 combination and then switching to the next and repeating the process on the next combination, is repeated over and over again in accordance with the particular engine's firing order.

Notably, the exemplary arrangement illustrated in FIGS. 4–9 determines when the coil has completely discharged at the end of the final discharge, as well as when the predetermined amount of energy has been stored in the coil, not by monitoring the high-voltage secondary side of the coils, but rather by monitoring the primary side of each coil. This advantageously eliminates the need for high-voltage monitoring hardware, as well as the additional costs and/or space requirements associated therewith.

Another advantage of the exemplary embodiment illustrated in FIGS. 3–9 is that it is fully compatible with existing PTCUs that provide successive EST pulses, each EST pulse having a temporal width that determines the charging time of the coil prior to the initial spark, and a trailing edge that is designed to trigger the sparking event.

The present invention, however, is not limited to such an embodiment. To the contrary, the multicharging system of the present invention can be made to respond to different kinds of PTCUs, including those which provide temporally wider EST pulses (e.g., lasting as long as the intended duration of the multicharging and multiple sparking sequence for each chambers' firing) or those which provide two EST pulses for each multicharging and multiple sparking sequence (e.g., a first EST pulse having a duration corresponding to the initial charging time of the coil and separated from the beginning of the next EST pulse by a period of time corresponding to the initial partial discharge time of the coil, the second EST pulse having a duration corresponding to how long the cycles of recharging and partially discharging are to continue).

Figure 10:
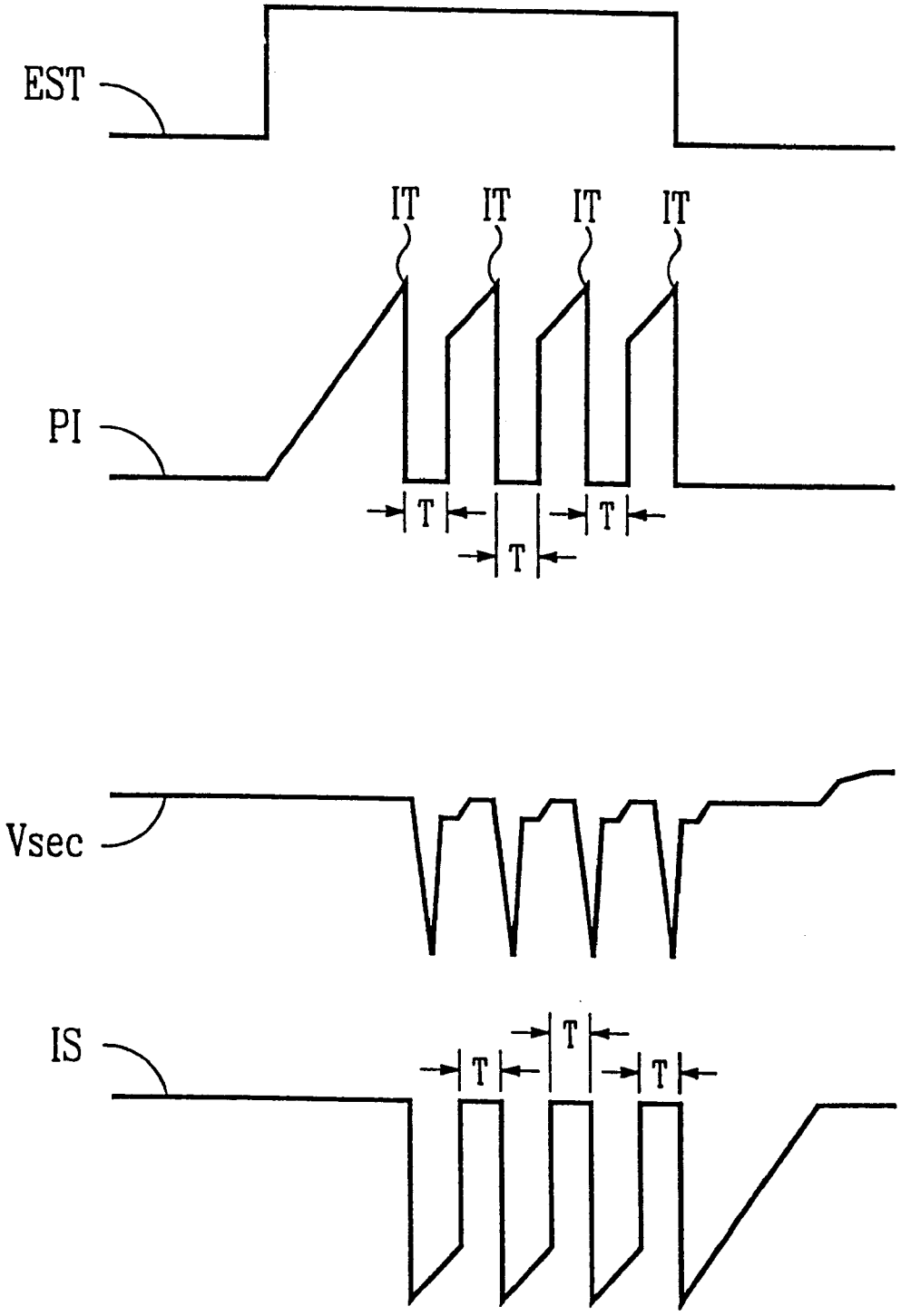
FIG. 10 is a timing diagram of an alternative implementation of the multicharging method according to the present invention.

FIG. 10 is a timing diagram illustrating the EST pulse, the primary winding current PI, the voltage across the spark plug (across the secondary winding) VSEC, and the secondary winding current SI, all in connection with a method and system that uses the width of the EST pulse to determine how long the multicharging and multisparking sequence will last, and that also uses the rising edge of the EST pulse to trigger the initial charging of the coil.

According to this alternative method, the EST pulse triggers the initial charging of the coil. This charging continues until the predetermined current threshold IT is reached, at which point, the current path through the primary winding is opened. Discharging of the coil through the secondary side therefore commences and continues for the predetermined period of time T. The predetermined period of time T, as indicated above, is long enough for only a portion of the energy in the coil to discharge. At the end of the a predetermined period of time T, the current path through the primary winding is again closed to effect recharging of the coil. This recharging continues until the predetermined current threshold IT is achieved through the primary winding, at which time, the primary winding is opened again to achieve another partial discharge. This process of repetitively reopening the primary current path in response to the predetermined current threshold IT being reached and closing it at the predetermined period of time T thereafter, continues so long as the EST pulse remains high. After the EST pulse drops, however, the current path through the primary winding is kept from closing The multicharging process therefore ends approximately when the EST pulse drops.

Since opening of the primary current path to effect the partial discharge is triggered in a current-dependent manner, not a strictly time-based manner, this alternative method also advantageously ensures that the proper amount of energy is stored in the coil before the next partial discharge commences. This, in turn, enhances sparking reliability, and prevents variations in combustion chamber conditions (e.g., changes in flow) from having any significant negative impact on this reliability.

Figure 11:
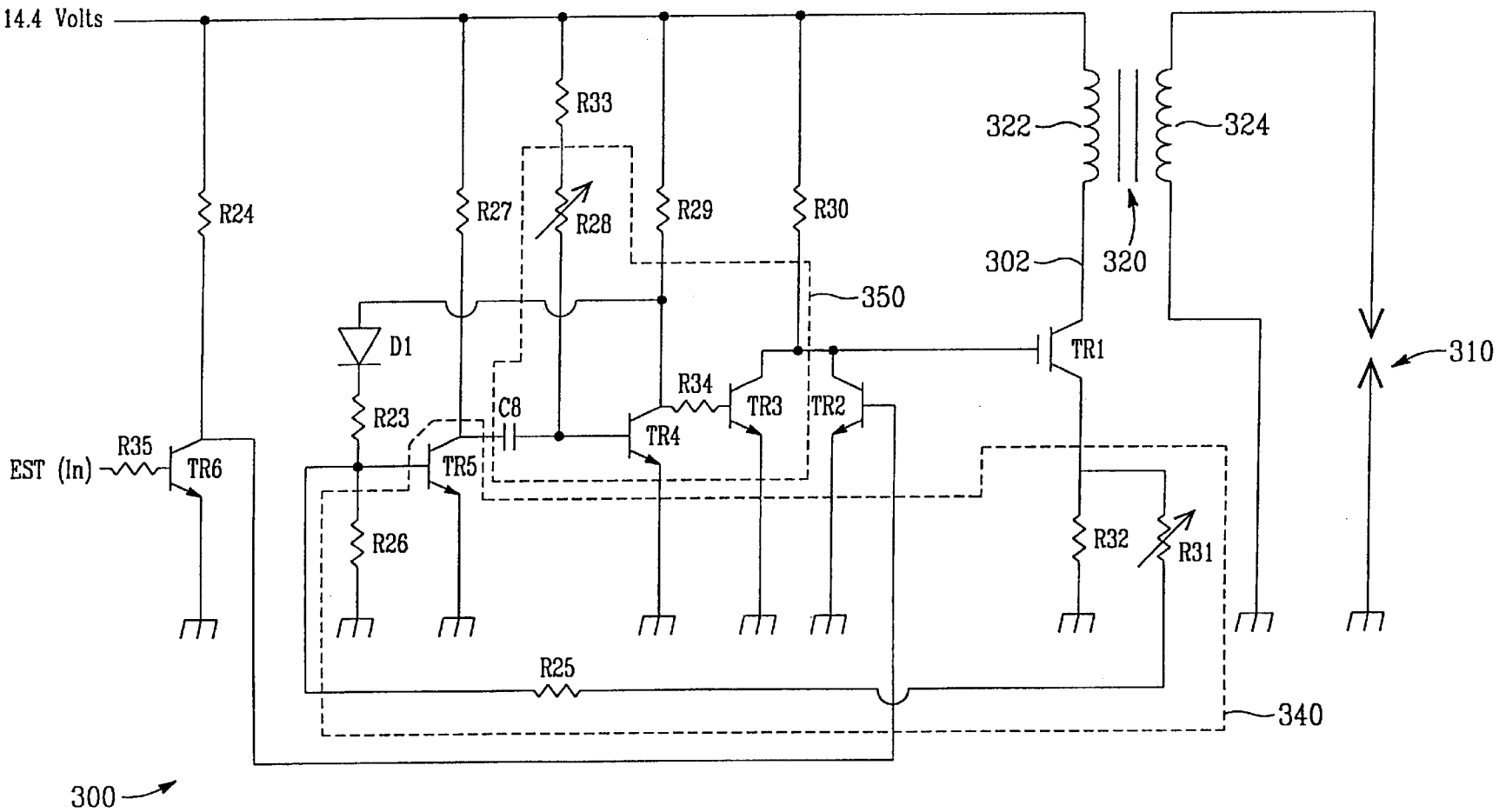
FIG. 11 is a schematic diagram showing exemplary electronic circuitry adapted to control the flow of current according to the timing diagram of FIG. 10.

FIG. 11 shows exemplary electronic ignition circuitry 300 which is adapted to control the flow of current through the current path in the manner indicated by the timing diagram of FIG. 10. Since the circuitry 300 is relatively simple to implement and requires very little space, each spark plug 310 can be provided with a coil 320 and one of the electronic ignition circuitry 300. Each combustion chamber therefore can have its own independent circuitry 300 and its own coil 320. The exemplary coil 320 in FIG. 10 has a primary winding inductance of about 0.85 mH, a secondary winding inductance of about 2.9 H, a primary winding resistance of about 0.15 ohm, and a secondary winding resistance of about 2500 ohms. The following chart describes exemplary characteristics of the circuit components illustrated in FIG. 11:

| Reference Number | Description |
|---|---|
| C8 | 0.22 micro Farad capacitor |
| R23 | 10k ohm resistor |
| R24 | 2.2k ohm resistor |
| R25 | 1k ohm resistor |
| R26 | 4.7k ohm resistor |
| R27 | 2.2k ohm resistor |
| R28 | 0–10k ohm potentiometer |
| R29 | 10k ohm resistor |
| R30 | 2.2k ohm resistor |
| R31 | 0–10k ohm potentiometer |
| R32 | 0.1 ohm resistor |
| R33 | 4.7k ohm resistor |
| R34 | 10k ohm resistor |
| R35 | 10k ohm resistor |
| D1 | diode |
| TR1 | IGBT |
| TR2 | transistor |

-continued

| Reference Number | Description |
|---|---|
| TR3 | transistor |
| TR4 | transistor |
| TR5 | transistor |
| TR6 | transistor |

Electronic ignition circuitry 300 includes a current path switch TR1 (e.g. an IGBT), an EST-responsive transistor TR6, a current control circuit 340, and a discharge timer circuit 350. The switch TR1 is connected to the current path 302 and thereby directly controls the flow of current through the primary winding 322 of the coil 320.

More specifically, the switch TR1 is adapted to selectively open the current path 302 when the current flowing through the path 302 rises to the predetermined current threshold IT. As indicated above, the predetermined current threshold IT is reached when the inductive energy stored in the coil 320 corresponds to the predetermined amount of energy. The switch TR1 therefore opens when the predetermined amount of energy is stored in the coil 320.

In order to make the switch TR1 responsive to the predetermined current threshold IT, its opening is controlled by the current control circuit 340. The exemplary current control circuit 340 includes the transistor TR5, the resistors R25,R26,R32, and the potentiometer R31. The resistance exhibited by the potentiometer R31 is adjusted so that the current control circuit 340 causes the switch TR1 to open when the current flowing through the path 302 rises to the predetermined current threshold IT. Different predetermined current thresholds IT can be provided by merely changing the resistance exhibited by the potentiometer R31.

Connected between the current control circuit 340 and the gate of the switch TR1 is the discharge timer circuit 350. The discharge timer circuit 350 is what causes the switch TR1 to close within the predetermined period of time T after being opened by the current control circuit 340. The discharge timer circuit 350 includes the potentiometer R28, the capacitor C8, and the transistors TR3, TR4. The combination of the potentiometer R28 and capacitor C8 provides an RC circuit. The RC circuit is tuned to provide the desired predetermined period of time T. By merely adjusting the resistance provided by the potentiometer R28, this predetermined period of time T can be changed to accommodated differences in engine design and requirements.

The resistance provided by the potentiometer R28 therefore is selectively chosen so that the RC circuit causes the transistor TR3 to close the switch TR1 at the predetermined period of time T after being opened by the current control circuit 340. The transistor TR3, in this regard, provides a time-out signal to the switch TR1 (by grounding its gate) indicating to the switch TR1 that the predetermined period of time T has elapsed and that it is time for the switch TR1 to close to thereby effect recharging of the coil 320. Such closure of the switch TR1 to effect recharging, however, is possible only when the EST pulse is present at the EST-responsive transistor TR6.

The EST-responsive transistor TR6 has its base terminal connected to the EST signal from the PTCU. When the EST pulse is absent from the base terminal of the transistor TR6, the transistor TR6 creates an open circuit condition across its other terminals. A positive voltage therefore appears at the base terminal of the transistor TR2. In response to this positive voltage, the transistor TR2 grounds the gate of the switch TR1 to prevent the flow of current through the primary winding 322 of the coil 320, regardless of the status of transistor TR3. The exemplary electronic ignition circuitry 300 thus is adapted to respond to a terminal portion of the EST pulse by precluding reopening of the current path 302 as long as the EST signal remains absent.

By contrast, when the EST pulse is present at the base terminal of the transistor TR6, a closed circuit condition is created through the other terminals of the EST-responsive transistor TR6. This closed circuit condition causes the base terminal of the transistor TR2 to be grounded, and thereby creates an open circuit condition across the other terminals of the transistor TR2. As long as this open circuit condition remains (i.e., as long as the EST pulse is present), the voltage, if any, at the gate of the switch TR1 is controlled by the status of transistor TR3.

An exemplary multicharge sequence performed by the circuitry 300 will now be described. Prior to multicharging, the EST signal is low. The transistor TR6 therefore keeps the switch TR1 open by applying a positive voltage to the gate of the transistor TR2, which in turn, grounds the gate of the switch TR1. There is consequently little, if any, energy stored in the coil 320.

When the EST pulse appears, the transistor TR6 grounds the base terminal of the transistor TR2 and thereby allows the status of the switch TR1 to be determined by the status of transistor TR3. Since the positive voltage at the base of transistor TR4 effectively grounds the base terminal of transistor TR3, an open circuit is provided across the other terminals of transistor TR3. A positive voltage therefore is applied to the gate of switch TR1. In response to this positive voltage, the switch TR1 closes to permit the flow of current through the current path 302 and the primary winding 322 of the coil 320. This current flow progressively rises as the coil continues to charge.

When the current flow through the primary winding 322 and current path 302 rises to the predetermined current threshold IT, the corresponding voltage at the base terminal of the transistor TR5 causes that transistor to close the circuit through its other terminals. The other terminals of the transistor TR5 therefore are grounded. This switching-to-ground action causes the base terminal of the transistor TR4 to be momentarily grounded through the capacitor C8. The other terminals of the transistor TR4 therefore provide an open circuit condition which, in turn, allows a positive voltage to appear at the base terminal of the transistor TR3. The transistor TR3 responds to this positive voltage by grounding the gate of the switch TR1. The current path 302 thereby is opened to effect partial discharging of the coil 320 through its secondary winding 324 and the spark plug 310.

During the partial discharge, the lack of current flow through the current path 302 causes the voltage at the base terminal of the transistor TR5 to drop. This drop in voltage at the base terminal of the transistor TR5 causes its other terminals to again exhibit an open circuit condition. A positive voltage therefore appears between the resistor R29 and the capacitor C8. The voltage at the base terminal of the transistor TR4, however, does not return immediately to the voltage required to close the switch TR1. Instead, this is delayed by the time constant of the RC circuit (formed by R28 and C8), which delay corresponds to the predetermined period of time T.

After the predetermined period of time T, the voltage at the base terminal of the transistor TR4 causes its other terminals to exhibit a closed circuit condition. This effectively grounds the base terminal of the transistor TR3 and thereby causes the other terminals of the transistor TR3 to exhibit an open circuit condition. A positive voltage therefore appears at the gate of switch TR1. In response to this positive voltage, the switch TR1 closes the current path 302 through the primary winding 322 and the coil 320 begins to recharge.

Recharging continues until the transistor TR5 switches again to a closed circuit condition in response to the predetermined current threshold IT. The process of opening the switch TR1 when the predetermined current threshold IT is achieved and closing it after the predetermined period of time T elapses, is repeated so long as the EST pulse remains present.

When the EST signal goes low at the trailing edge of the EST pulse, the transistor TR6 exhibits an open circuit condition. The resulting positive voltage at the base terminal of the transistor TR2 causes the transistor TR2 to substantially ground the gate of the switch TR1. The switch TR1 therefore opens to prevent the flow of current through the current path 302. The coil 320 then is permitted to discharge completely through its secondary winding 324 and the spark plug 310. Recharging thereafter is not commenced until another EST pulse is received.

From the foregoing description, it is readily apparent that the circuitry 300 is responsive to a first transition (e.g., the transition from low to high) in the EST signal (or timing signal) directing the circuitry 300 to commence charging of the coil 320 (or inductive energy storage device). The circuitry 300, in response to the first transition, commences charging of the coil 320.

It also is readily apparent that the circuitry 300 is responsive to a second transition (e.g., a transition from high to low) in the EST signal (or timing signal) directing the circuitry 300 to keep the path 302 open at least until a subsequent transition in the EST signal. In response to the second transition, the circuitry 300 keeps the current path 302 open, thereby terminating the repetitions of closing and reopening the path 302 and permitting the predetermined amount of energy to be discharged substantially completely through the secondary winding 324, at least until a subsequent transition in the EST signal (or timing signal) is applied to the circuitry 300.

Since the circuitry 300 commences recharging well before complete discharging can be achieved by limiting the discharge to the predetermined period of time T when the EST pulse is present, the circuitry 300 advantageously uses the most efficient part of the recharging and discharging cycle as it provides the multicharging and multisparking sequence.

The circuitry 300 illustrated in FIG. 11, while generally effective, can be improved by providing compensation for changes in temperature and battery voltage. The system in FIG. 11 does not include such compensation to demonstrate one of the more simple forms of the present invention.

Figure 12:
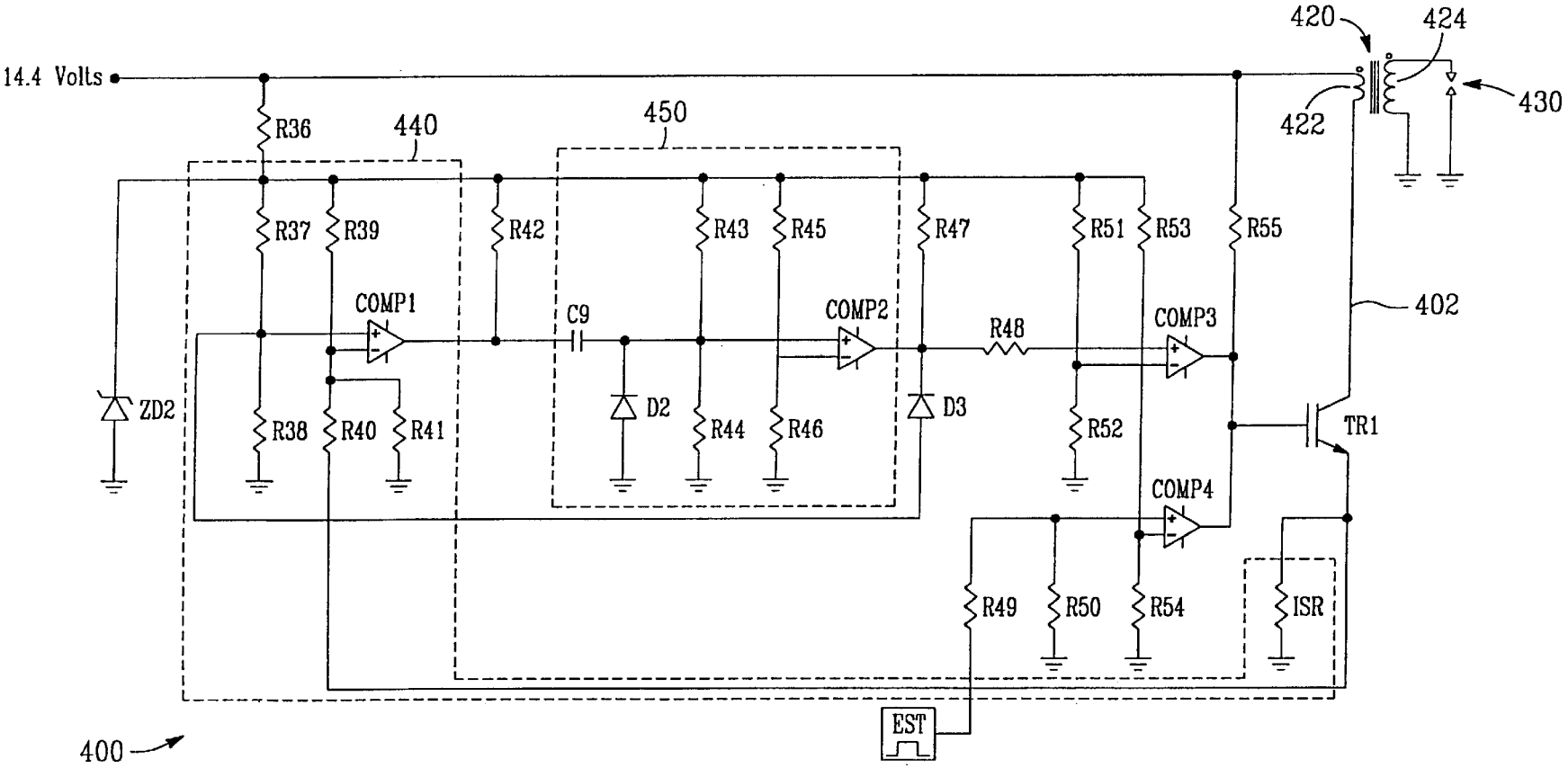
FIG. 12 is a schematic diagram showing an alternative embodiment of the circuitry illustrated in FIG. 11.

FIG. 12 illustrates alternative circuitry 400 capable of compensating for variations in temperature and battery voltage. The following chart provides a description of exemplary components which can be used to implement the electronic ignition circuitry 400 shown in FIG. 12:

| Reference Number | Description |
|---|---|
| COMP1 | LM 339 comparator |
| COMP2 | LM 339 comparator |

-continued

| Reference Number | Description |
|---|---|
| COMP3 | LM 339 comparator |
| COMP4 | LM 339 comparator |
| ZD2 | zener diode for voltage regulation at 7.5 volts |
| D2 | diode (1N4004) |
| D3 | diode (1N4004) |
| TR1 | insulated gate bipolar transistor (IGBT) |
| R36 | 1k ohm resistor |
| R37 | 0–10k ohm potentiometer |
| R38 | 2.7k ohm resistor |
| R39 | 5.1k ohm resistor |
| R40 | 2.7k ohm resistor |
| R41 | 2.7k ohm resistor |
| R42 | 4.7k ohm resistor |
| R43 | 10k ohm resistor |
| R44 | 47k ohm resistor |
| R45 | 10k ohm resistor |
| R46 | 1k ohm resistor |
| R47 | 10k ohm resistor |
| R48 | 4.7k ohm resistor |
| R49 | 2.7k ohm resistor |
| R50 | 15k ohm resistor |
| R51 | 36k ohm resistor |
| R52 | 4.7k ohm resistor |
| R53 | 36k ohm resistor |
| R54 | 2.7k ohm resistor |
| R55 | 1.5k ohm resistor |
| ISR | current sense resistor with a resistance between 0.05 and 0.065 ohm |
| C9 | 1 micro Farad capacitor |

The alternative circuitry 400 shown in FIG. 12 is connected to the primary winding 422 of the ignition coil 420. The secondary winding 424 of the ignition coil 420 is electrically connected across the gap of the spark plug 430.

Each electronic ignition circuitry 400 includes a current path switch TR1 (e.g. an IGBT), an EST-responsive comparator COMP4, a current control circuit 440, and a discharge timer circuit 450. The switch TR1 is connected to the current path 402 and thereby directly controls the flow of current through the primary winding 422 of the coil 420. More specifically, the switch TR1 is adapted to selectively open the current path 402 when the current flowing through the path 402 rises to the predetermined current threshold IT.

In order to make the switch TR1 responsive to the predetermined current threshold IT, its opening is controlled by the current control circuit 440. The exemplary current control circuit 440 includes the comparator COMP1, the resistors R38,R39,R40,R41, the current sense resistor ISR, and the potentiometer R47. The resistance exhibited by the potentiometer R47 is adjusted so that the current control circuit 440 causes the switch TR1 to open when the current flowing through the path 402 rises to the predetermined current threshold IT. Different predetermined current thresholds IT can be provided by merely changing the resistance exhibited by the potentiometer R47. Preferably, the current sense resistor exhibits a voltage drop of about 0.75 volts when the current flow through the current sense resistor ISR is equal to the predetermined current threshold IT.

Connected between the current control circuit 440 and the gate of the switch TR1 is the discharge timer circuit 450. The discharge timer circuit 450 is what causes the switch TR1 to close within the predetermined period of time T after being opened by the current control circuit 440. The discharge timer circuit 450 primarily operates as a "one shot." The discharge timer circuit 450 includes the potentiometer R43, the capacitor C9, and the comparator COMP2. The combination of the potentiometer R43 and capacitor C9 provides an RC circuit. The RC circuit is tuned to provide the desired predetermined period of time T. By merely adjusting the resistance provided by the potentiometer R43, the predetermined period of time T can be changed to accommodate differences in engine design or requirements.

The resistance provided by the potentiometer R43 therefore is selectively chosen so that the RC circuit causes the comparator COMP2 to close the switch TR1, via the comparator COMP3, at the predetermined period of time T after being opened by the current control circuit 440. In this regard, the comparator COMP2 provides a time-out signal to the switch TR1, via the comparator COMP3, indicating to the switch TR1 that the predetermined period of time T has elapsed and that it is time for the switch TR1 to close to thereby effect recharging of the coil 420. Such closure of the switch TR1 to effect recharging, however, is possible only when the EST pulse is present at the EST-responsive comparator COMP4.

The EST-responsive comparator COMP4 has its non-inverting input terminal connected electrically via the resistor R49 to the EST signal from the PTCU. When the EST pulse is absent from the non-inverting input terminal of the comparator COMP4, the comparator COMP4 switches its output terminal to the inverted state. This effectively opens the switch TR1 to prevent the flow of current through the primary winding 422 of the coil 420, regardless of the output from comparator COMP3. The exemplary electronic ignition circuitry 400 thus is adapted to respond to a terminal portion of the EST pulse by precluding reopening of the current path 402 as long as the EST signal remains absent.

By contrast, when the EST pulse is present at the non-inverting input terminal of the comparator COMP4, the output from the comparator COMP4 relinquishes control over the switch TR1 to the output from the comparator COMP3.

An exemplary multicharge sequence performed by the circuitry 400 will now be described. Prior to multicharging, the EST signal is low. The comparator COMP3 therefore keeps its output in the inverted state and thereby keeps the switch TR1 from closing. There is consequently little, if any, inductive energy stored in the coil 420.

When the EST pulse appears, the comparator COMP4 allows the status of the switch TR1 to be determined by the output from the comparator COMP3. Since the voltage across the current sense resistor ISR initially remains low, indicating that the current flowing through the path 402 has not reached the predetermined current threshold IT, the output from the comparator COMP1 remains high, thereby driving the outputs from the comparators COMP3, COMP4 also high. The switch TR1 responds to the high output signals by closing the current path 402 and allowing current to flow through the primary winding 422. This flow of current through the coil 420 progressively increases as the coil 420 continues to charge.

When the voltage across the current sense resistor ISR indicates that the predetermined current threshold IT has been achieved, the corresponding voltage at the inverting input of the comparator COMP1 causes the output of the comparator COMP1 to become inverted. This voltage inversion causes a sudden but temporary drop in voltage at the non-inverting input terminal of the comparator COMP2. The time it takes for the voltage at the non-inverting input terminal of the comparator COMP2 to return to a level higher than the voltage at the inverting input terminal of the comparator COMP2 is determined by the time constant of the RC circuit (R43 and C9). The comparator COMP2 responds to the temporary drop in voltage by inverting its output, and thereby causing the comparator COMP3 to invert its output. The inverted output from the comparator COMP3 causes the switch TR1 to open, and thereby causes the coil 420 to begin its partial discharge through the secondary winding 424 and through the gap of the spark plug 430.

Since the resistance provided by the potentiometer R43 is adjusted to provide a time constant in the RC circuit (R43 and C9) that corresponds to the predetermined period of time T, the voltage at the non-inverting input terminal of the comparator COMP2 returns, at the end of the predetermined period of time T, to a voltage level sufficient to drive the comparator COMP2 out of the inverted state. This transition by the comparator COMP2 out of the inverted state is conveyed to the non-inverting input terminal of the comparator COMP3. The comparator COMP3 responds by switching out of the inverted state. Since this causes the switch TR1 to close at the end of the predetermined period of time T, the circuit 400 effectively causes recharging of the coil 420 to commence at the end of the predetermined period of time T.

Prior to expiration of the predetermined period of time T (i.e., during the partial discharge period), the diode D3 prevents the comparator COMP1 from switching its output back to the non-inverted state. In effect, the diode D3 ties this switch-back operation to the output status of the comparator COMP2. Only after the output from the comparator COMP2 returns to the non-inverted state, does the diode D3 allow the output from the comparator COMP1 to switch back to its non-inverted state.

After the predetermined period of time T, recharging continues until the voltage at the inverting input of the comparator COMP1 again indicates that the predetermined current threshold IT has been reached and causes the output of the comparator COMP1 to become inverted. The switch TR1 therefore opens, and another partial discharge is performed for the predetermined period of time T. The process of opening the switch TR1 when the predetermined current threshold IT is achieved and closing it after the predetermined period of time T elapses, is repeated so long as the EST pulse remains present.

When the EST signal goes low at the trailing edge of the EST pulse, the EST-responsive comparator COMP4 responds by switching its output to the inverted state. As indicated above, this causes the switch TR1 to remain open and prevents the flow of current through the current path 402. The coil 420 then is permitted to discharge completely through its secondary winding 424 and the spark plug 410. Recharging thereafter is not commenced until another EST pulse is received.

From the foregoing description, it is readily apparent that the circuitry 400 is responsive to a first transition (e.g., the transition from low to high) in the EST signal (or timing signal) directing the circuitry 400 to commence charging of the coil 420 (or inductive energy storage device). The circuitry 400, in response to the first transition, commences charging of the coil 420.

It also is readily apparent that the circuitry 400 is responsive to a second transition (e.g., a transition from high to low) in the EST signal (or timing signal) directing the circuitry 400 to keep the path 402 open at least until a subsequent transition in the EST signal. In response to the second transition, the circuitry 400 keeps the current path 402 open, thereby terminating the repetitions of closing and reopening the path 402 and permitting the predetermined amount of energy to be discharged substantially completely through the secondary winding 424, at least until a subsequent transition in the EST signal (or timing signal) is applied to the circuitry 400.

Since the circuitry 400 commences recharging well before complete discharging can be achieved by limiting the discharge to the predetermined period of time T when the EST pulse is present, the circuitry 400 advantageously uses the most efficient part of the recharging and discharging cycle as it provides the multicharging and multisparking sequence.

Should the desirability of using existing EST pulses from conventional PTCUs diminish, or it otherwise becomes desirable or practical to modify how the PTCU provides the EST pulses, the present invention also provides a multicharging ignition system and method which is responsive to two successive EST pulses for each power stroke.

Figure 13:
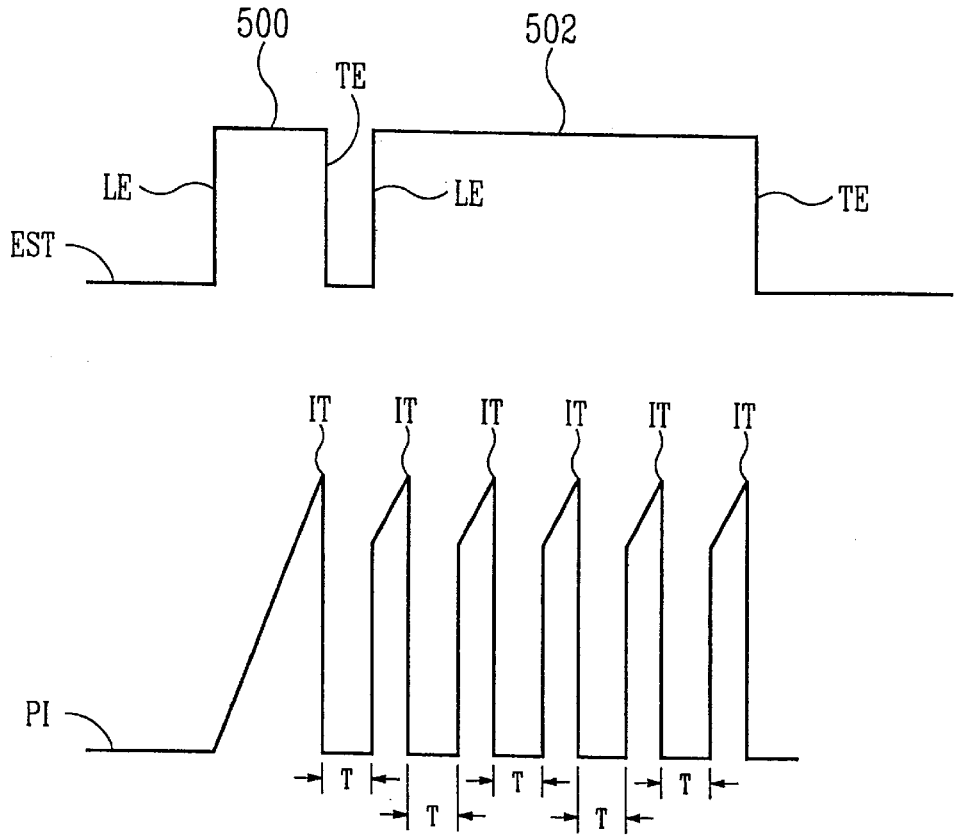
FIG. 13 is a timing diagram showing another alternative implementation of the multicharging method according to the present invention.

With reference to FIG. 13, the first pulse 500 of the two EST pulses 500,502 triggers the initial charging of the coil. In particular, the leading edge LE of the first pulse 500 causes the primary current PI to be turned on (i.e., it closes the circuit through the primary winding). The duration of the first pulse 500 determines how long the primary current PI remains on and therefore determines how long the coil will be charged. This duration thus corresponds to the time required to store the predetermined amount of energy in the coil. As shown in FIG. 13, the current PI through the primary winding progressively increases as the coil becomes charged during the first pulse 500.

The trailing edge TE of the first pulse 500 then triggers the initial partial discharge of the coil. In particular, the trailing edge TE of the first pulse 500 causes the circuit through the primary winding to open, thereby terminating the primary current PI and commencing a first partial discharge of the coil through the secondary winding of the coil and through a spark plug connected thereto. The duration of the first partial discharge is determined by the time between the trailing edge TE of the first pulse 500 and the leading edge LE of the second pulse 502. By controlling the time between the pulses 500,502, the PTCU is able to selectively determine how much energy will be discharged during the first partial discharge. Preferably, the time between the trailing edge TE of the first pulse 500 and the leading edge LE of the second pulse 502 is no more than half the time required for the coil to completely discharge.

The second pulse 502 also has a duration determined by the PTCU. The duration of the second pulse 502 corresponds to a desired multicharge duration during which the coil is repetitively charged and partially discharged. The trailing edge TE of the second pulse 502 signifies the end of the multicharging and multisparking sequence for that particular power stroke.

During the repetitions of charging and partially discharging, the discharge time preferably remains equal to the time between the first and second pulses 500,502 (i.e., the time between the trailing edge TE of the first pulse 500 and the leading edge LE of the second pulse 502). Closure of the circuit through the primary winding, in this regard, is triggered at the predetermined period of time T after opening of that circuit. The opening of the circuit through the primary winding after the initial partial discharge, by contrast, is triggered based on the amount of current flowing through the primary winding. Preferably, the circuit is opened when the primary current reaches the predetermined current threshold IT.

In order to implement the exemplary method shown in FIG. 13, it is understood that the EST separator 52, multicharge controller 54, and driver array 56 can be modified to respond appropriately to the successive pulses 500,502. The EPROM 100 in FIG. 4, for example, can be programmed to respond appropriately to the successive pulses 500,502, and the driver array can be modified to effect switching to the next coil and spark plug combination only after both pulses 500,502 are received.

Such an ignition system therefore would be responsive to first, second, third, and fourth transitions in a timing signal (e.g., the EST signal from the suitably modified PTCU), wherein: 1) the first transition (e.g., the leading edge LE of the first pulse 500) directs the electronic ignition circuitry to commence initial charging of the inductive energy storage device (e.g., the coil); 2) the second transition (e.g., the trailing edge TE of the first pulse 500) indicates that charging of the inductive energy storage device has continued for a period of time sufficient to achieve the predetermined amount of energy, to which the electronic ignition circuitry responds by closing the path through the primary winding to effect a first partial discharge of the predetermined amount of energy; 3) a third transition (e.g., the leading edge LE of the second pulse 502) directing the electronic ignition circuitry to commence the repetitions of closing and reopening the current path through the primary winding to recharge and partially discharge, respectively, the inductive energy storage device through its secondary side; and 4) a fourth transition (e.g., the trailing edge TE of the second pulse 502) directing the electronic ignition circuitry to terminate the repetitions by discharging the predetermined amount of energy substantially completely through the secondary side.

Figure 14:
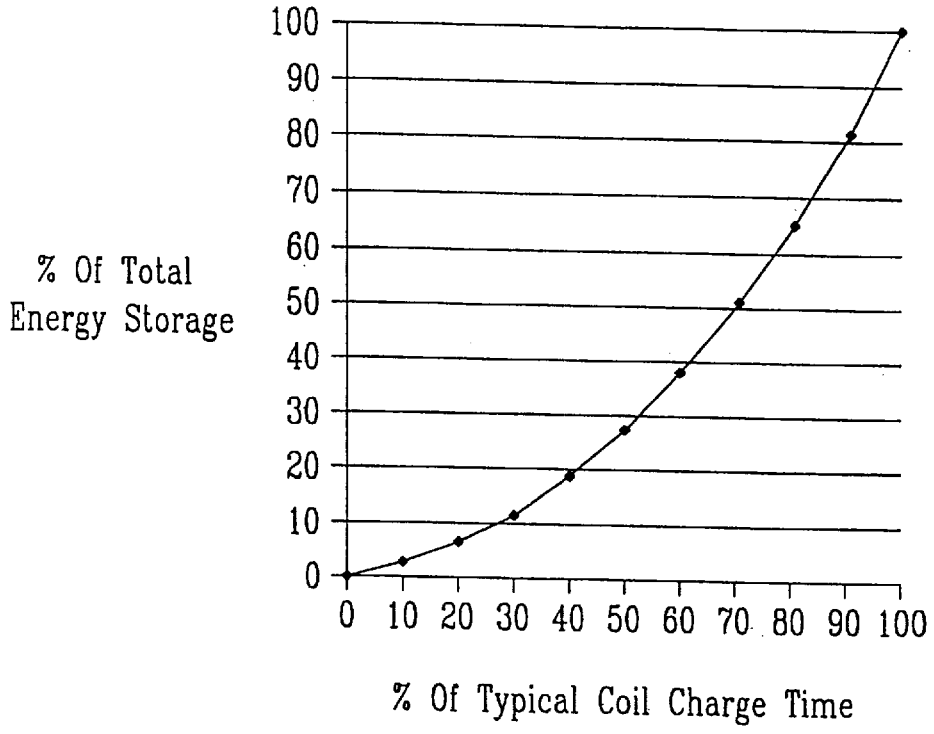
FIG. 14 is a graph showing the percentage of total energy storage in an ignition coil versus the percentage of time required to charge the coil to that energy level.
Figure 15:
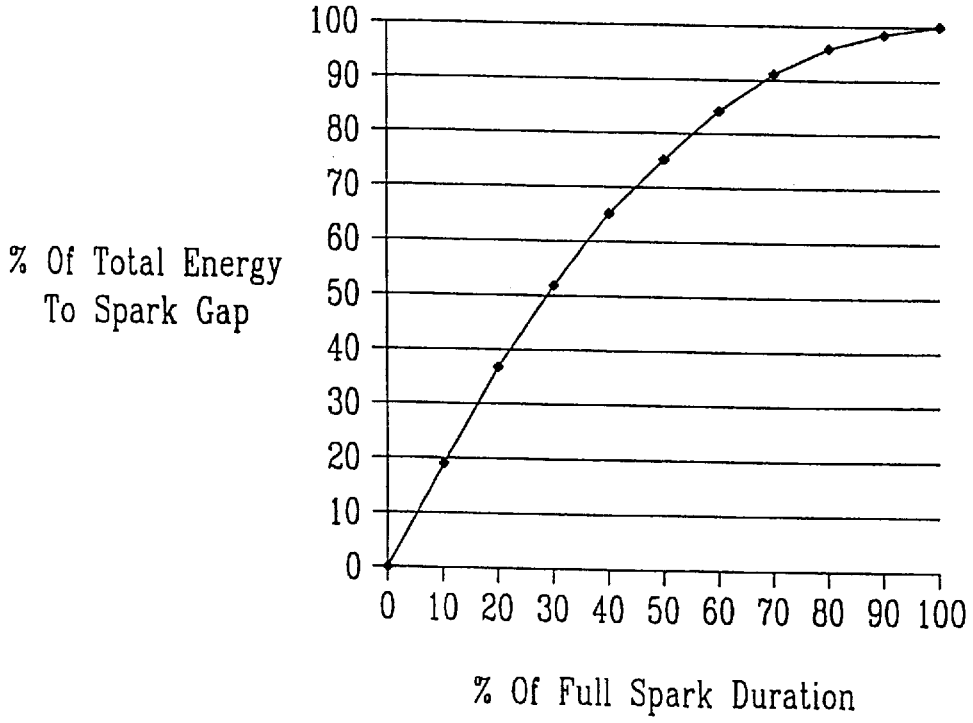
FIG. 15 is a graph showing the percentage of total energy discharged from an ignition coil versus the percentage of full spark duration.

With reference to FIGS. 14 and 15, by limiting the discharge time during the multicharging and multisparking sequence to no more than half the time required to achieve a complete discharge of the coil, the foregoing implementations of the present invention utilize the most efficient aspects of the coil charging and discharging cycle. As shown in FIG. 14, the final 50% of the time required to charge the coil to a predetermined energy level results in storage of approximately 75% of that energy. Likewise, as shown in FIG. 15, approximately 75% of the energy in the coil is discharged during the first half of the time required to achieve a complete discharge of the coil.

Figure 16:
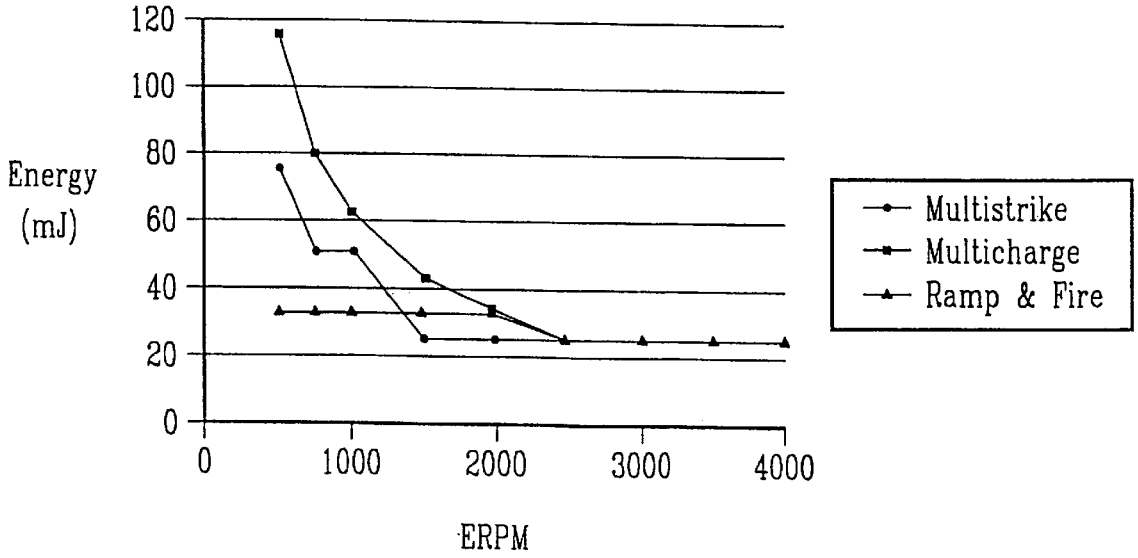
FIG. 16 is a graph of the energy delivered by different ignition systems as a function of engine RPM.

FIG. 16 shows how the multicharging approach compares to other ignition techniques. In particular, FIG. 16 is a graph of the energy delivered as a function of engine RPM, at a "worst case" timing for an ion sense application (zero degree advance). From FIG. 16, it becomes readily apparent that only a modest boost in energy is possible using the "ramp-and-fire" technique. To accomplish this, the primary break current is increased from a nominal 15 amperes to 20 amperes. The current increase, however, may require a higher-rated IGBT.

The multistrike approach is capable of delivering somewhat more energy at very low speeds, but with the limitation that the successive energy pulses are too late to contribute to the desired combustion process. The multicharge approach of the present invention, by contrast, accepts and releases energy at a much faster rate and operates primarily on the high power portion of the discharge. This, in turn, tends to enhance early flame kernel development while advantageously retaining the long duration for stratified mixtures.

Multicharging also advantageously allows the coil to be arbitrarily small at the expense of higher frequency operation. Switching losses will establish the better trade-off between size and frequency. This concept is not limited to ion sense. This may contribute significantly to efforts to reduce coil size while increasing energy and duration.

While AC ignition could provide performance similar to the multicharge approach, it does so at a much higher cost and using more complex circuitry. AC ignition circuitry, for example, requires a power supply with its additional components, as well as a high temperature filter capacitor. Such high temperature filter capacitors, even if they exist, can be very expensive.

Although the exemplary implementation illustrated in FIG. 3 provides a single multicharge controller 54 that receives all of the EST pulses and distributes the desired sparking sequence to all of the combustion chambers via the driver array 56, a more preferred embodiment for engines having multiple combustion chambers provides each combustion chamber (or group of similarly actuated combustion chambers) with its own electronic ignition circuitry 24 operating in response to the PTCU 34 (e.g., in response to the EST pulse). The preferred system's responsiveness to existing PTCUs 34 and the EST pulses therefrom, advantageously avoids the need to reconfigure the existing PTCUs and also avoids the need to provide the electronic ignition circuitry 24 with inputs other than the EST pulses. While such arrangements tend to require duplication of the components in the electronic ignition circuitry 24, they advantageously allow each multicharge ignition circuitry 24 to be located immediately adjacent to its respective spark plug. In this regard, each electronic ignition circuitry 24 can be provided with a "pencil coil" at the respective spark plug, thereby minimizing or eliminating the need for high voltage components (e.g., high voltage spark plug wiring) that would otherwise extend beyond the vicinity of each spark plug.

Figure 17:
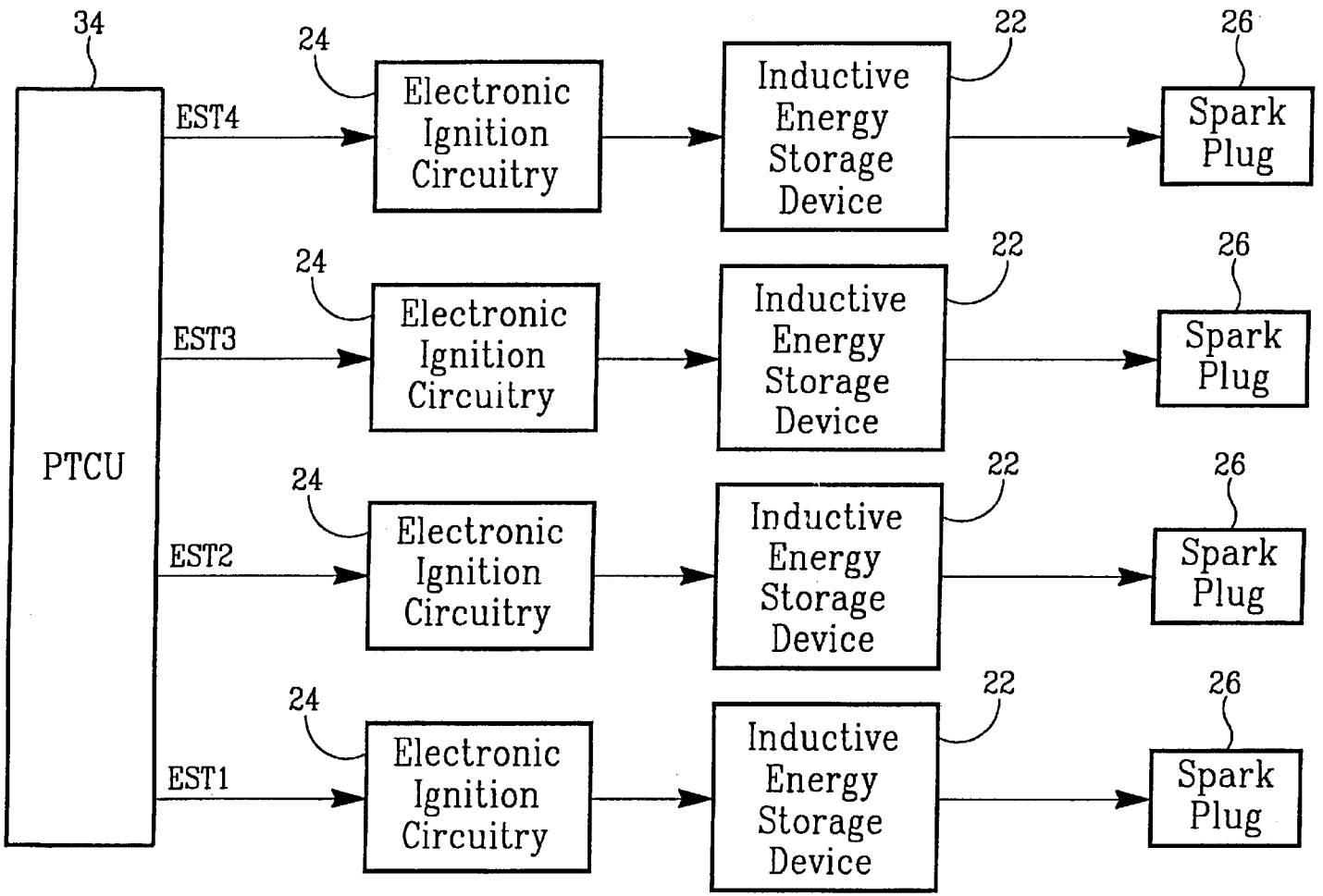
FIG. 17 is a block diagram of an exemplary multicharging ignition system having multiple electronic ignition circuits for engines having multiple combustion chambers.

With reference to FIG. 17, an exemplary implementation for a 4-cylinder engine is illustrated. An existing PTCU 34 provides four EST signals (EST1, EST2, EST3, EST4), one for each cylinder. Each spark plug 26 is provided with its own electronic ignition circuitry 24 and its own inductive energy storage device 22 (e.g., an ignition coil). The electronic ignition circuitry 24 can be implemented using any of the foregoing exemplary implementations, with appropriate modifications. The resulting arrangement obviates the need for the driver array 56 and the EST separator 52, and reduces the requirements of the diode array 220 in FIG. 7 to only one diode connected to the primary winding of the respective inductive energy storage device 22. Each electronic ignition circuitry 24 therefore controls its respective switch (e.g., one of the IGBTs 230 shown in FIG. 8) through a buffer 126 or 127, to selective apply the primary current in the manner described above, in response to the respective EST pulse from the PTCU 34. This advantageously can be accomplished without the need for any other input signal. There is consequently no need to provide the electronic ignition circuitry with a separate signal indicative of crank angle, or any other signal for that matter.

The 4-cylinder implementation of illustrated in FIG. 17 is merely an exemplary embodiment. One having ordinary skill would have no trouble extending the foregoing teachings to 6-cylinder, 8-cylinder, and other numbers and arrangements of combustion chambers.

The embodiments described above advantageously can be implemented using small, low-cost coils, and do not require very complex electronic components. The improvement in performance provided by the exemplary embodiments is especially apparent when the spark plugs are fouled. It also enables operation with colder heat range spark plugs, and thereby reduces the number of spark plug models required. There is also a marked improvement in lean mixture startability.

Advantageously, the present invention can be applied to ion sense arrangements, arrangements using direct gasoline injection, and 2-stroke engines. It also represents a reliable alternative to providing a high energy coil near the spark plugs.

While the present invention has been described with reference to certain preferred embodiments and implementations, it is understood that various modifications and variations will no doubt occur to those skilled in the art to which this invention pertains. For example, the number of sparks and duration of each spark may be varied from that disclosed herein. These and all other such variations which basically rely of the teachings through which this disclosure has advanced the art are properly considered within the scope of this invention.

What is claimed is:

1. A multicharge ignition system for connection to a spark plug of an internal combustion engine, said multicharge ignition system comprising:

an inductive energy storage device having primary and secondary sides inductively coupled to one another; and electronic ignition circuitry connected to said primary side and provided to receive an EST pulse timing signal indicative of when firing of the spark plug is to commence and responsive to said EST pulse timing signal by initially charging said inductive energy storage device by flowing electrical current through said primary side until a fall in said EST pulse timing signal to store a predetermined amount of energy in said inductive energy storage device, said electronic ignition circuitry being further provided to discharge a portion of said predetermined amount of energy through said secondary side by opening a path of said electrical current through said primary side of said inductive energy storage device dependent upon and substantially coincident with said fall in said EST timing signal, said electronic ignition circuitry being further provided to close said path and reopen said path repetitively to recharge and partially discharge, respectively, said inductive energy storage device such that reopening of said path is triggered based on the amount of energy stored in said inductive energy storage device, said ignition circuitry being further provided to terminate the sequence of recharging and partially discharging the inductive energy storage device solely based on said EST pulse timing signal and without requiring other signals indicative of crank angle.

2. The multicharge ignition system of claim 1, wherein said electronic ignition circuitry is adapted to respond to a terminal portion of said timing signal by precluding reopening of said path in the absence of said timing signal.

3. The multicharge ignition system of claim 1, wherein said electronic ignition circuitry further includes a switch connected to said path and adapted to selectively open said path when the current flowing through said path rises to a predetermined threshold at which the inductive energy stored in said inductive energy storage device corresponds to said predetermined amount of energy.

4. The multicharge ignition system of claim 3, wherein said electronic ignition circuitry further includes timing circuitry adapted to provide a time-out signal when a predetermined period of time has elapsed after opening of said switch, said switch being further responsive to said time-out signal and being adapted to close said path upon receiving said time-out signal to effect recharging of said inductive energy storage device.

5. The multicharge ignition system of claim 4, wherein said predetermined threshold is a value of current between 5 and 15 amperes, and wherein said predetermined period of time is between about 0.15 and 0.2 millisecond.

6. The multicharge ignition system of claim 3, wherein said switch is arranged so as to preclude closure of said path when an aspect of said timing signal is absent.

7. The multicharge ignition system of claim 1, wherein said electronic ignition circuitry is adapted to limit a discharge time during which said path is open to no more than half of the time it would take for said predetermined amount of energy to be completely discharged through said secondary side, except when the path is opened for a last repetition in a desired sparking duration, in which case said electronic ignition circuitry keeps said path open long enough for said predetermined amount of energy to be discharged substantially completely through said secondary side, said desired sparking duration corresponding to a time during which it is desirable to have a spark present at the spark plug.

8. The multicharge ignition system of claim 1, wherein said electronic ignition circuitry is responsive to:

a first transition in said timing signal directing said electronic ignition circuitry to commence initial charging of said inductive energy storage device;

a second transition in said timing signal indicating that charging of said inductive energy storage device has continued for a period of time sufficient to achieve said predetermined amount of energy, to which said electronic ignition circuitry responds by closing said path to effect a first partial discharge of said predetermined amount of energy;

a third transition in said timing signal directing said electronic ignition circuitry to commence said repetitions of closing and reopening said path to recharge and partially discharge, respectively, said inductive energy storage device through said secondary side; and a fourth transition in said timing signal directing said electronic ignition circuitry to terminate said repetitions by discharging said predetermined amount of energy substantially completely through said secondary side.

9. The multicharge ignition system of claim 1, wherein said electronic ignition circuitry is responsive to:

a first transition in said timing signal directing said electronic ignition circuitry to commence charging of said inductive energy storage device, and a second transition in said timing signal directing said electronic ignition circuitry to keep said path open at least until a subsequent transition in said timing signal, thereby terminating said repetitions of closing and reopening said path and permitting said predetermined amount of energy to be discharged substantially completely through said secondary side; and wherein said electronic ignition circuitry is adapted to commence charging of said inductive energy storage device in response to said first transition and is further adapted to keep said path open in response to said second transition, at least until a subsequent transition in said timing signal is applied to said electronic ignition circuitry.

10. The multicharge ignition system of claim 1, wherein said electronic ignition circuitry is adapted to determine, prior to each repetition of said closing and reopening, whether a next repetition, if executed so that the reopening is long enough to discharge said predetermined amount of energy substantially completely through said secondary side, would require said next repetition to extend beyond a predetermined desired sparking duration during which it is desirable to have a spark present at the spark plug, said electronic ignition circuitry being further adapted to open said path for a period of time long enough for said predetermined amount of energy to be discharged substantially completely through said secondary side when it is determined that said next repetition would extend beyond the predetermined desired sparking duration.

11. The multicharge ignition system of claim 10, wherein said electronic ignition circuitry is adapted to make said determination regarding the next repetition based on how long it took to complete a previous cycle of:

closing said path;

opening said path; and keeping said path open long enough for said predetermined amount of energy to be discharged substantially completely through said secondary side.

12. The multicharge ignition system of claim 1, wherein said electronic ignition circuitry is responsive to:

a first transition in said timing signal directing said electronic ignition circuitry to commence initial charging of said inductive energy storage device; and a second transition in said timing signal indicating that charging of said inductive energy storage device has continued for a period of time sufficient to achieve said predetermined amount of energy, to which said electronic ignition circuitry responds by closing said path to effect a first partial discharge of said predetermined amount of energy through said secondary side.

13. In an internal combustion engine having a timing control unit, a plurality of combustion chambers, and at least one spark plug in each combustion chamber, a separate multicharge ignition system connected to each spark plug and also connected to said timing control unit, each of said multicharge ignition systems comprising:

an inductive energy storage device for each combustion chamber, each inductive energy storage device having primary and secondary sides inductively coupled to one another; and electronic ignition circuitry connected to said primary side of each inductive energy storage device and provided to receive, from said timing control unit, an EST pulse timing signal indicative of when firing of each spark plug is to commence, said electronic ignition circuitry being responsive to said EST pulse timing signal by initially charging a respective one of said inductive energy storage devices by flowing electrical current through the primary side thereof until a fall in said EST pulse timing signal to store a predetermined amount of energy therein, said electronic ignition circuitry being further provided to discharge a portion of said predetermined amount of energy through the secondary side of said respective one of said inductive energy storage devices by opening a path of said electrical current through said primary side of said inductive energy storage device dependent upon and substantially coincident with said fall in said EST pulse timing signal, said electronic ignition circuitry being further adapted to close said path and reopen said path repetitively to subsequently recharge and partially discharge, respectively, said respective one of said inductive energy storage devices, said electronic ignition circuitry being adapted to sequentially designate, in a predetermined firing order, which of the inductive energy storage devices constitutes said respective one, said ignition circuitry being further adapted to terminate the sequence of recharging and partially discharging the inductive energy storage device based solely on said timing signal and without requiring other signals indicative of crank angle.

14. The multicharge ignition system of claim 13, wherein said electronic ignition circuitry is adapted to respond to a terminal portion of said timing signal by precluding reopening of said path in the absence of said timing signal.

15. The multicharge ignition system of claim 13, wherein said electronic ignition circuitry further includes a switch connected to each path and adapted to selectively open the path when the current flowing through said path rises to a predetermined threshold at which the inductive energy stored in said respective one of said inductive energy storage devices corresponds to said predetermined amount of energy.

16. The multicharge ignition system of claim 15, wherein said electronic ignition circuitry further includes timing circuitry adapted to provide a time-out signal when a predetermined period of time has elapsed after opening of said switch, said switch being further responsive to said time-out signal and being adapted to close said path upon receiving said time-out signal to effect recharging of said respective one of said inductive energy storage devices.

17. The multicharge ignition system of claim 16, wherein said predetermined threshold is a value of current between 5 and 15 amperes, and wherein said predetermined period of time is between about 0.15 and 0.2 millisecond.

18. The multicharge ignition system of claim 15, wherein said switch is arranged so as to preclude closure of said path when an aspect of said timing signal is absent.

19. The multicharge ignition system of claim 13, wherein said electronic ignition circuitry is adapted to limit a discharge time during which said path is open to no more than half of the time it would take for said predetermined amount of energy to be completely discharged through said secondary side, except when the path is opened for a last repetition in a desired sparking duration, in which case said electronic ignition circuitry keeps said path open long enough for said predetermined amount of energy to be discharged substantially completely through said secondary side, said desired sparking duration corresponding to a time during which it is desirable to have a spark present at the spark plug.

20. The multicharge ignition system of claim 13, wherein said electronic ignition circuitry is responsive to:

a first transition in said timing signal directing said electronic ignition circuitry to commence initial charging of said respective one of the inductive energy storage devices;

a second transition in said timing signal indicating that charging of said respective one of said inductive energy storage devices has continued for a period of time sufficient to achieve said predetermined amount of energy, to which said electronic ignition circuitry responds by closing said path to effect a first partial discharge of said predetermined amount of energy;

a third transition in said timing signal directing said electronic ignition circuitry to commence said repetitions of closing and reopening said path to recharge and partially discharge, respectively, said respective one of said inductive energy storage devices through the secondary side thereof; and a fourth transition in said timing signal directing said electronic ignition circuitry to terminate said repetitions by discharging said predetermined amount of energy substantially completely through said secondary side.

21. The multicharge ignition system of claim 13, wherein said electronic ignition circuitry is responsive to:

a first transition in said timing signal directing said electronic ignition circuitry to commence charging of said respective one of said inductive energy storage devices, and a second transition in said timing signal directing said electronic ignition circuitry to keep said path open at least until a subsequent transition in said timing signal, thereby terminating said repetitions of closing and reopening said path and permitting said predetermined amount of energy to be discharged substantially completely through said secondary side; and wherein said electronic ignition circuitry is adapted to commence charging of said respective one of said inductive energy storage devices in response to said first transition and is further adapted to keep said path open in response to said second transition, at least until a subsequent transition in said timing signal is applied to said electronic ignition circuitry.

22. The multicharge ignition system of claim 13, wherein said electronic ignition circuitry is adapted to determine, prior to each repetition of said closing and reopening, whether a next repetition, if executed so that the reopening is long enough to discharge said predetermined amount of energy substantially completely through said secondary side, would require said next repetition to extend beyond a predetermined desired sparking duration during which it is desirable to have a spark present at the spark plug, said electronic ignition circuitry being further adapted to open said path for a period of time long enough for said predetermined amount of energy to be discharged substantially completely through said secondary side when it is determined that said next repetition would extend beyond the predetermined desired sparking duration.

23. The multicharge ignition system of claim 22, wherein said electronic ignition circuitry is adapted to make said determination regarding the next repetition based on how long it took to complete a previous cycle of:

closing said path;

opening said path; and keeping said path open long enough for said predetermined amount of energy to be discharged substantially completely through said secondary side.

24. The multicharge ignition system of claim 13, wherein said electronic ignition circuitry is responsive to:

a first transition in said timing signal directing said electronic ignition circuitry to commence initial charging of said inductive energy storage device; and a second transition in said timing signal indicating that charging of said inductive energy storage device has continued for a period of time sufficient to achieve said predetermined amount of energy, to which said electronic ignition circuitry responds by closing said path to effect a first partial discharge of said predetermined amount of energy through said secondary side.

25. A method of providing multicharge ignition for an internal combustion engine, said method comprising the steps of:

initially charging, in response to and substantially coincident with a rise in an EST pulse timing signal, an inductive energy storage device by flowing electrical current through a primary side of the inductive energy storage device until a fall in said EST pulse timing signal to store a predetermined amount of energy therein;

initially discharging a portion of said predetermined amount of energy in response to and substantially coincident with said fall of said EST pulse timing signal through a secondary side of said inductive energy storage device by opening a path of said electrical current through said primary side of said inductive energy storage device;

repetitively closing and reopening said path to subsequently recharge and partially discharge, respectively, said inductive energy storage device, wherein reopening of said path is triggered based on the amount of energy stored in said inductive energy storage device; and terminating said step of repetitively closing and reopening, based solely on said timing signal without requiring other signals indicative of crank angle.

26. The method of claim 25, further comprising the step of precluding reopening of said path in the absence of said timing signal.

27. The method of claim 25, wherein reopening of said path is triggered by the current flowing through said path rising to a predetermined threshold at which the inductive energy stored in said inductive energy storage device corresponds to said predetermined amount of energy.

28. The method of claim 27, wherein said step of repetitively closing and reopening said path commences in response to passage of a predetermined period of time after said charging step commences.

29. The method of claim 28, wherein said predetermined threshold is a value of current between 5 and 15 amperes, and wherein said predetermined period of time is between about 0.15 and 0.2 millisecond.

30. The method of claim 25, further comprising the steps of:

limiting a discharge time during which said path is open to no more than half of the time it would take for said predetermined amount of energy to be completely discharged through said secondary side, except when the path is opened for a last repetition in a desired sparking duration; and when the path is opened for said last repetition in the desired sparking duration, keeping said path open long enough for said predetermined amount of energy to be discharged substantially completely through said secondary side, said desired sparking duration corresponding to a time during which it is desirable to have a spark present.

31. The method of claim 25, wherein said charging step commences in response to a first transition in said timing signal;

wherein said discharging step is triggered by a second transition in said timing signal indicating that charging has continued for a period of time sufficient to achieve said predetermined amount of energy;

wherein said step of repetitively closing and reopening said path is triggered by a third transition in said timing signal; and wherein said step of repetitively closing and opening said path is terminated in response to a fourth transition in said timing signal, by discharging said predetermined amount of energy substantially completely through said secondary side.

32. The method of claim 25, wherein said charging step is triggered by a first transition in said timing signal, and further comprising the step of keeping said path open, in response to a second transition in said timing signal, at least until a subsequent transition in said timing signal, to terminate said step of repetitively closing and reopening said path by permitting said predetermined amount of energy to be discharged substantially completely through said secondary side.

33. The method of claim 25, wherein said step of repetitively closing and reopening said path includes the step of determining, prior to each repetition of closing and reopening, whether a next repetition, if executed so that the reopening is long enough to discharge said predetermined amount of energy substantially completely through said secondary side, would require said next repetition to extend beyond a predetermined desired sparking duration during which it is desirable to have a spark present at the spark plug, and further comprising the step of opening said path for a period of time long enough for said predetermined amount of energy to be discharged substantially completely through said secondary side when it is determined that said next repetition would extend beyond the predetermined desired sparking duration.

34. The method of claim 33, wherein said determining step is performed based on how long it took to complete a previous cycle of:

closing said path; and keeping said path open long enough for said predetermined amount of energy to be discharged substantially completely through said secondary side.

35. The method of claim 25, further comprising the step of sequentially applying said steps of charging, discharging, and repetitively closing and reopening, to different inductive energy storage devices of the internal combustion engine, pursuant to a predetermined firing order of said internal combustion engine.

36. In an internal combustion engine having a timing control unit, a plurality of combustion chambers, and at least one spark plug in each combustion chamber, a separate multicharge ignition system connected to each spark plug and also connected to said timing control unit, each of said multicharge ignition systems comprising:

an inductive energy storage device for each combustion chamber, each inductive energy storage device having primary and secondary sides inductively coupled to one another; and electronic ignition circuitry for each combustion chamber, each electronic ignition circuitry being connected to a respective primary side of a respective inductive energy storage device and provided to receive, from said timing control unit, a respective EST pulse timing signal indicative of when firing of a respective spark plug is to commence, each electronic ignition circuitry being responsive to said respective EST pulse timing signal by initially charging its respective inductive energy storage device by flowing electrical current through the primary side thereof until a fall in said EST pulse timing signal to store a predetermined amount of energy therein, each electronic ignition circuitry being further provided to discharge a portion of said predetermined amount of energy through the secondary side of its respective inductive energy storage device by opening a path of said electrical current through said primary side of said respective inductive energy storage device dependent upon and substantially coincident with said fall in said EST pulse timing signal, each electronic ignition circuitry being further provided to close said path and reopen said path repetitively to subsequently recharge and partially discharge, respectively, its respective inductive energy storage device, each electronic ignition circuitry being further arranged so that reopening of said path is triggered based on the amount of energy stored in said inductive energy storage device, each ignition circuitry being further provided to terminate the sequence of recharging and partially discharging the inductive energy storage device solely based on said respective timing signal and without requiring other signals indicative of crank angle.

37. The multicharge ignition system of claim 36, wherein each electronic ignition circuitry is adapted to respond to a terminal portion of said respective timing signal by precluding reopening of said path in the absence of said respective timing signal.

38. The multicharge ignition system of claim 36, wherein each electronic ignition circuitry further includes a switch connected to said path and adapted to selectively open the path when the current flowing through said path rises to a predetermined threshold at which the inductive energy stored in said respective inductive energy storage device corresponds to said predetermined amount of energy.

39. The multicharge ignition system of claim 38, wherein each electronic ignition circuitry further includes timing circuitry adapted to provide a time-out signal when a predetermined period of time has elapsed after opening of said switch, said switch being further responsive to said time-out signal and being adapted to close said path upon receiving said time-out signal to effect recharging of said respective inductive energy storage device.

40. The multicharge ignition system of claim 39, wherein said predetermined threshold is a value of current between 5 and 15 amperes, and wherein said predetermined period of time is between about 0.15 and 0.2 millisecond.

41. The multicharge ignition system of claim 38, wherein each switch is arranged so as to preclude closure of said path when an aspect of said respective timing signal is absent.

42. The multicharge ignition system of claim 36, wherein each electronic ignition circuitry is adapted to limit a discharge time during which said path is open to no more than half of the time it would take for said predetermined amount of energy to be completely discharged through said secondary side, except when the path is opened for a last repetition in a desired sparking duration, in which case each electronic ignition circuitry keeps said path open long enough for said predetermined amount of energy to be discharged substantially completely through said secondary side, said desired sparking duration corresponding to a time during which it is desirable to have a spark present at the respective spark plug.

43. The multicharge ignition system of claim 36, wherein each electronic ignition circuitry is responsive to:

a first transition in said respective timing signal directing said electronic ignition circuitry to commence initial charging of said respective inductive energy storage device;

a second transition in said respective timing signal indicating that charging of said respective inductive energy storage devices has continued for a period of time sufficient to achieve said predetermined amount of energy, to which said electronic ignition circuitry responds by closing said path to effect a first partial discharge of said predetermined amount of energy;

a third transition in said respective timing signal directing said electronic ignition circuitry to commence said repetitions of closing and reopening said path to recharge and partially discharge, respectively, said respective inductive energy storage device through the secondary side thereof; and a fourth transition in said respective timing signal directing said electronic ignition circuitry to terminate said repetitions by discharging said predetermined amount of energy substantially completely through said secondary side.

44. The multicharge ignition system of claim 36, wherein each electronic ignition circuitry is responsive to:

a first transition in said respective timing signal directing said electronic ignition circuitry to commence charging of said respective inductive energy storage device, and a second transition in said respective timing signal directing said electronic ignition circuitry to keep said path open at least until a subsequent transition in said respective timing signal, thereby terminating said repetitions of closing and reopening said path and permitting said predetermined amount of energy to be discharged substantially completely through said secondary side; and wherein each electronic ignition circuitry is adapted to commence charging of said respective inductive energy storage device in response to said first transition and is further adapted to keep said path open in response to said second transition, at least until a subsequent transition in said respective timing signal is applied to said electronic ignition circuitry.

45. The multicharge ignition system of claim 36, wherein each electronic ignition circuitry is adapted to determine, prior to each repetition of said closing and reopening, whether a next repetition, if executed so that the reopening is long enough to discharge said predetermined amount of energy substantially completely through said secondary side, would require said next repetition to extend beyond a predetermined desired sparking duration during which it is desirable to have a spark present at the respective spark plug, each electronic ignition circuitry being further adapted to open said path for a period of time long enough for said predetermined amount of energy to be discharged substantially completely through said secondary side when it is determined that said next repetition would extend beyond the predetermined desired sparking duration.

46. The multicharge ignition system of claim 45, wherein each electronic ignition circuitry is adapted to make said determination regarding the next repetition based on how long it took to complete a previous cycle of:

closing said path;

opening said path; and keeping said path open long enough for said predetermined amount of energy to be discharged substantially completely through said secondary side.

47. The multicharge ignition system of claim 36, wherein each electronic ignition circuitry is responsive to:

a first transition in said respective timing signal directing said electronic ignition circuitry to commence initial charging of said respective inductive energy storage device; and a second transition in said respective timing signal indicating that charging of said respective inductive energy storage device has continued for a period of time sufficient to achieve said predetermined amount of energy, to which said electronic ignition circuitry responds by closing said path to effect a first partial discharge of said predetermined amount of energy through said secondary side.

* * * * *